US007224342B2

(12) United States Patent
Chen et al.

(10) Patent No.: US 7,224,342 B2
(45) Date of Patent: May 29, 2007

(54) METHOD AND DEVICE USED FOR ELIMINATING IMAGE OVERLAP BLURRING PHENOMENON BETWEEN FRAMES IN PROCESS OF SIMULATING CRT IMPULSE TYPE IMAGE DISPLAY

(75) Inventors: Cheng-Jung Chen, Chu-Nan County (TW); Yuh-Ren Shen, Tai-Nan (TW)

(73) Assignee: Vastview Technology Inc., Hsinchu (TW)

( * ) Notice: Subject to any disclaimer, the term of this patent is extended or adjusted under 35 U.S.C. 154(b) by 594 days.

(21) Appl. No.: 10/862,516

(22) Filed: Jun. 5, 2004

(65) Prior Publication Data

US 2006/0033698 A1 Feb. 16, 2006

(51) Int. Cl.
*G09G 3/36* (2006.01)

(52) U.S. Cl. ..... 345/102; 345/87; 345/94; 345/204

(58) Field of Classification Search ..... 345/102, 345/87, 94, 98, 204
See application file for complete search history.

(56) References Cited

U.S. PATENT DOCUMENTS

| | | | | |
|---|---|---|---|---|
| 6,927,766 | B2 * | 8/2005 | Tagawa et al. | 345/204 |
| 7,027,018 | B2 * | 4/2006 | Nitta et al. | 345/87 |
| 2002/0003520 | A1 * | 1/2002 | Aoki | 345/87 |
| 2002/0044116 | A1 * | 4/2002 | Tagawa et al. | 345/87 |
| 2003/0142118 | A1 * | 7/2003 | Funamoto et al. | 345/691 |
| 2004/0001054 | A1 * | 1/2004 | Nitta et al. | 345/204 |
| 2004/0012551 | A1 * | 1/2004 | Ishii | 345/87 |
| 2004/0217932 | A1 * | 11/2004 | Nally et al. | 345/92 |
| 2005/0134547 | A1 * | 6/2005 | Wyatt | 345/102 |

* cited by examiner

*Primary Examiner*—Richard Hjerpe
*Assistant Examiner*—Kimnhung Nguyen

(57) ABSTRACT

Disclosed is a device for eliminating after image overlap blurring phenomenon between frames in the simulation of CRT impulse type image display with liquid crystal display (LCD), including first and second input control lines; first and second input data lines; first and second capacitors; a driving voltage output line; a first transistor including a first gate connected to a first input control line, a first source connected to a first input data line, and a first drain connected to a driving voltage output line, a first capacitor and the drain of the second transistor; and a second transistor including a second gate connected to a second input control line, a second source connected to a second input data line, and a second drain connected to a driving voltage output line, the drain of the first transistor and the second capacitor. The first and second capacitors are connected to ground respectively. The driving voltage output line supplies a simulation driving voltage to pixels of an LCD panel for displaying images and including a backlight unit with adjustable and controllable luminance and a backlight input voltage control line. The first and second input control lines are connected to a gate driver. The first and second data lines are connected to a data driver respectively. During the interval of black lines scanning, when the luminance of the backlight unit is reduced to the lowest value through its control voltage, the accumulated liquid crystal optical response in that interval is brought to the lowest value.

30 Claims, 13 Drawing Sheets

Frame: N-1
N
N+1
N+2
Code from32 to 120
Lq 5
Lq 4
VLC
Code 32(V2)
Code 0 (V1)
Code 0 (V1')
Code 120 V3
Code 120 V3'
V1'
a
b
(c)
(d)
e
time Point :
A1
A2
A3
A4
A5
A6
A7
A8
BV1
BV0
BL1
BL0
BV1
BV0
Time Frame: N-1
N
N+1
N+2
Code from32 to 120
$V_{LC}$
Code 32(V2)
Code 0 (V1)
Code 0 (V1')
V3
V1
V3'
V1'
time Point :
A1
A2
A3
A4
A5
A6
A7
A8
Lq 3
Lq 2
Lq 1
$B_{V1}$
$B_{V0}$
$B_{L1}$
$B_{L0}$
Time Frame: N-1
N
N+1
N+2
Code from32 to 120
VLC
Code 32(V2)
Code 0 (V1)
Code 0 (V1')
V3'
V1'
V3
V1
time Point :
A1
A2
A3
A4
A5
A6
A7
A8
Lq 3
Lq 2
Lq 1
BV1
BV0
BL1
BL0
Time Time
Frame: N-1
N
N+1
N+2
Code from32 to 120
VLC
Code 32(V2)
Code 0 (V1)
Code 0 (V1')
V3
V1
V3'
V1'
time Point : A1 A2 A3 A4 A5 A6 A7 A8
Lq 3
Lq 2
Lq 1
BV1
BV0
BL1
BL0

Frame: N-1
N
N+1
N+2
Code from32 to 120
VLC
Code 32(V2)
Code 0 (V1)
Code 0 (V1')
V3
V1
V3'
V1'
time Point :
A1
A2
A3
A4
A5
A6
A7
A8
Lq 3
Lq 2
Lq 1
BV1
BV0
BL1
BL0
Time Time
N+2
N+1
N
Frame:N-1
Code from32 to 120
VLC
Code 0 (V1')
Code 32(V2)
Code 0 (V1)
Code 120
V3'
V1'
V3
V1
A1
A2
A3
A4
A5
A6
A7
A8
Lq 3
Lq 2
Lq 1
time Point :
BV1
BV0
BL1
BL0

Time
Frame: N-1
N
N+1
N+2
Code from32 to 120
VLC
Code 0 (V1')
Code 32(V2)
Code 0 (V1)
Code 120
V3'
V1'
V3
V1
A1
A2
A3
A4
A5
A6
A7
A8
Lq 3
Lq 2
Lq 1
time Point :
BV1
BV0
BL1
BL0

METHOD AND DEVICE USED FOR ELIMINATING IMAGE OVERLAP BLURRING PHENOMENON BETWEEN FRAMES IN PROCESS OF SIMULATING CRT IMPULSE TYPE IMAGE DISPLAY

BACKGROUND OF THE INVENTION

1. Field of the Invention

The present invention relates to the method and device used for eliminating the image overlap blurring phenomenon between frames in the process of simulating CRT impulse type image display, and more particularly, to the method and device used for eliminating the after image overlap blurring phenomenon between frames in the process of simulating CRT impulse type image display with liquid crystal display (LCD).

2. The Prior Arts

In recent years, liquid crystal display (LCD) device have been very popular and widely used, and the varieties of its products are enormous, from the consumer electronic products to computers and the mobile phone wireless communication applications, such that the technology progress and development of the LCD device is rapidly advancing, and its trend is in agreement with the future trend of the development of the electronic products toward the features of light weight, thin thickness, short length, small size, low power consumption, and low heat dissipation, etc. And especially the development and progress of the technology of the Liquid Crystal Display is sufficiently advanced to overcome the restrictions and shortcomings of the traditional and the present displaying technologies such as Cathode Ray Tube (CRT) or Light Emitting Diode (LED), and it plays an important role in the development and application of computer, communication equipment and other consumer electronic products, and thus the LCD technology does indeed have great future and potential in this field.

The flat display effect of LCD is apparently superior to the image display effect of CRT, and in addition, its power consumption and its heat dissipation are much lower than those of the similar size CRT display. Therefore, this type of display is usually considered as suitable to use in the following applications: portable (mobile) phone display unit, TV receiver, display, and panel in exhibition center or advertisement applications.

In addition, for the LED utilized widely at present, which is subject to the limitations in various practical applications due to its inherent characteristics, such as, the LED is preferably used in the static display for numbers, characters, or images, and is not comparable to and can not match the LCD technology which is capable of dynamic image display and be able to achieve the effect of liveliness and vividness.

Presently, the televisions and display devices made with the technology of liquid crystal display have been produced in large quantities, to replace the televisions and display devices made with the conventional CRT. However, in the liquid crystal display technology of the present days there still exist drawbacks and limitations that must be overcome and improved.

With regard to the image display of CRT, it utilizes the "impulse type "image display. It produces light emissions by means of irradiating a single electron beam on the pixels coated with fluorescence materials. However, the pixel only produces the emission of light in an instant of a minute portion of time in each frame period. Therefore, it seems that almost no visional overlapping phenomenon will be noticed for the images displayed between the frames.

However, for the LCD image display, it utilizes the "hold type" image display due to the intrinsic property of the LCD material. It produces the image display through the optical response (namely, the gray level response) by means of applying driving voltages on the LCD material. Nevertheless, due to the limitation of the intrinsic property of the liquid crystal material, the image it displays occupies the predominant portion of time of that frame. And for each time its image changes, its luminance (or brightness) also changes step-wise sequentially. Therefore, from the viewpoint of the spectators, he may feel the overlapping of the image of the new frame on that of the old frame, thus creating the blurring of the image outlines and producing the phenomenon of the so-called "after-image".

In order to eliminate the above-mentioned after image produced by the LCD display device slow optical response, and the resulting image outline blurring phenomenon, currently most LCD television manufacturers try to convert the "hold type" image display of the LCD displaying device into the simulated (or pseudo) impulse type LCD displaying device similar to that of the CRT displaying device, by means of a kind of the so-called "over drive" technology, with its image only occupies a portion of the frame period, namely, the image is not displayed during a portion of each frame period.

The method utilized in this technology is a kind of so-called "over drive" method. It applies to the liquid crystal material the voltage (for example code 200) which is much higher than the originally set target voltage for example code 120), thus expediting and accelerating the optical response speed of the liquid crystal molecules, and accelerating them to reach the predetermined optical response value, and as such shortening the liquid crystal gray level response time to less than one frame period.

However, even the LCD display device made with this kind of over drive technology is able to shorten its gray level response time to less than and within one frame period, yet due to the intrinsic property of the liquid crystal, the generation of its optical response is slow so is its decline. Therefore, the image overlapping and the image outlines blurring phenomenon of the "after image" for the images displayed still can not be eliminated completely.

In order to completely eliminate the "after image", presently there are three methods adopted by the prior art, which are listed as follows:

(1) writing black data or black images into the frame in the remaining portion of that frame period after the original formal image is displayed;

(2) shutting off the backlight, for example, the blink light method as announced by Hitachi;

(3) the combination of the above methods (1) and (2), namely, both writing in black image and shutting off the backlight.

And in the following we will explain in detail their respective drawbacks and limitations.

However, the three above-mentioned methods have the following drawbacks and limitations, therefore their effects are not ideal, so that the "after image" overlap blurring phenomenon between frames still exists on the LCD screen: (1) necessitating the extra cost and expense of the additional equipment of frequency doubling device or backlight blinking equipment; (2) the electric magnetic interference incurred by the addition of such equipments; (3) for certain liquid crystal materials, their optical responses are fast from brightness to dark, and are slow from dark to brightness; but for other liquid crystal materials their optical responses are slow from brightness to dark, and are fast from dark to brightness.

In order to achieve for certain the effect of eliminating the phenomenon of "after image" overlap blurring displayed on the LCD display screen, the inventor of the present invention proposed a "Method And Device Used For Simulating CRT Impulse Type Image Display" in pending Taiwan Patent Application No. 98103825 to overcome the shortcomings and limitations of the prior art. In that pending paten application, the proposed method and device are mainly characterized in scanning the black lines, which is different from the prior art. By utilizing that proposed method and device, the period of the control voltage pulse used for the image display can be shortened to less than 8.3 ms (which corresponds to 120 Hz), and for which this period is adjustable, and the intervals of the scanning black lines applied during this period is also adjustable. As such, it can be applied to the various optical responses of various different liquid crystal materials, so as to achieve for certain the purpose of simulating CRT impulse type image display. Besides, it can avoid the extra cost and expense of the additional frequency-doubling device of the prior art and the resulting electric magnetic interference. In addition, the inventor of that patent application provides six Embodiments to attain similar but better effects, and thus achieving the important advance and breakthrough of the similar technology in this field.

However, for certain liquid crystal material its optical response is slower from brightness to dark, and during the black line scanning interval its optical response has not yet reached the sufficiently low value. As such, some of them still result in the phenomenon of certain "after image" overlap blurring. In order to thoroughly eliminate this phenomenon, and effectively achieve the ideal effect of simulating CRT image display with LCD display, the present inventor has dedicated his expertise, experience and ingenuity to the research and development of this subject, so as to bring about the realization of the present invention, and which will be discussed in detail as follows.

As such, the present application is the continuation or extension invention of the inventor's another pending Taiwan Patent Application No. 98103825, with its purpose as solving and improving the problem of image overlap blurring between frames in the process of "simulating CRT impulse type image display". However, as to how to scan the black lines to achieve "simulating CRT impulse type image display with LCD display", please refer to the prior patent applications of the present inventor, which will not be repeated here for brevity's sake.

SUMMARY OF THE INVENTION

Therefore, the purpose of the present invention is to provide the method and device used for the eliminating the image overlap blurring phenomenon between frames in the process of simulating CRT impulse type image display, so as to solve and overcome the shortcomings and limitations of the above-mentioned related prior art It controls and reduces the accumulated liquid crystal optical response during that interval to the lowest value desired by means of providing scanning black lines on the screen, and coupled with the reduction of backlight luminance to the appropriate low level, thus achieving for certain the purpose of simulating CRT impulse type image display. And by doing so, the present invention can effectively eliminate the phenomenon of image overlap blurring of the "after image" between frames. And as such, the present invention can significantly improve the image displaying quality of the LCD display, in addition to saving the extra cost and expense of the additional equipment.

In order to achieve the above-mentioned purpose, the present invention provides a device used for eliminating the image overlap blurring between frames in the process of simulating CRT image display with LCD display. In the following description, we will describe the design and operation principle of the device of the present invention with reference to the attached drawings. First, please refer to FIG. 1, which indicates the schematic diagram of the structure of the liquid display panel and backlight module according to the Embodiment of the present invention.

Next, please refer to FIGS. 2(*a*) to 2(*d*), which illustrate the design and operation principle of the device of the present invention by means of the description of the relations of waveforms between the driving voltage pulse $V_{LC}$ of the liquid crystal molecules $V_{LC}$, the backlight control voltage BV, backlight luminance response BL, and the accumulated liquid crystal optical response Lq.

Please refer to FIG. 2(*a*), wherein the solid line indicates the waveform of the liquid crystal driving voltage pulses $V_{LC}$ generated by the device of the present invention, its unit "code" is a kind of voltage unit, and the dotted line indicates the waveform of the resulting optical response of the liquid crystal molecules with nits as its unit; wherein the dotted line (c) indicates the waveform curve of the liquid crystal molecule optical response when the luminance of the backlight unit of the device has not been controlled and reduced to the sufficiently low level by the prior art; and the dotted line (d) indicates the waveform curve of the liquid crystal molecule optical response when the luminance of the backlight unit of the device has been controlled and reduced to the sufficiently low level by the present invention. Wherein, it is evident that the accumulated optical response of the said liquid crystal molecule can be reduced to the desired and sufficiently low level through scanning black lines on the display screen, and in cooperation with properly reducing the luminance of backlight unit as shown in the following FIG. 2(*c*). For example, the point "a" on the liquid crystal optical response curve (c) of the prior art of FIG. 2(*a*) can be lowered to point "b" on the liquid crystal optical response curve (d) of the present invention. Therefore, the "after image" overlap blurring phenomenon between frames N and N+1 can be eliminated, thus the present application can achieve the purpose of simulating CRT impulse type image display with LCD display, and this is the key point and characteristic of the present invention.

And then next, please refer to FIG. 2(*b*), it indicates the curve of the backlight control voltage (BV) with its unit as voltage (V), wherein BV1 is the value of the control voltage applied on the backlight unit during normal image display, while BV0 is the voltage applied when it is desired to reduce the luminance response of the backlight unit to the level required to eliminate the image blurring. The backlight unit can be line light source or point light source, which can be properly chosen from the following materials depending on the optical response and the image display desired to be achieved by the liquid crystal material and the effects of eliminating the after images: cold cathode fluorescence lamp (CCFL), light emitting diode (LED), organic light emitting diode (OLED), polymer light emitting diode (PLED), and electro-luminance (EL).

FIG. 2(*c*) indicates the luminance (BL) response curve of the backlight unit with luminance as its unit. Wherein, BL1 is the backlight luminance response used during normal image display, namely, it represents the backlight luminance response value created when control voltage BV1 is applied on the backlight unit as shown in FIG. 2(*b*), while BL0 is the backlight luminance response value of the reduced backlight luminance, which in cooperation with black line scanning eliminate the after image between frames on the display screen. The example shown in FIG. 2(*c*) makes use of the cold cathode fluorescence lamp (CCFL), and as such its luminance response indicates the V shape, and it must take a certain period of time to reach its lowest point e. Therefore, its luminance response evidently indicates the phenomenon of time delay. However, if light emitting diode (including LED, OLED, PLED) or electro-luminance (EL) is used, then the luminance response of the backlight unit is the immediate-target-value mode response curve, and it is of deep well shape as shown in FIG. 2(*d*), and the shape of the curve of backlight control voltage is also of deep well shape as shown in FIG. 2(*b*).

Summing up the above, the dotted line (c) in FIG. 2(*a*) indicates the liquid crystal optical response curve (c) generated by the black line scanning as utilized in the above-mentioned another pending patent application of the present inventor, and curve (d) is the liquid crystal optical response resulting from lowering the luminance response of the backlight unit to the lowest value through the design of the present invention. And by adding the liquid crystal molecule optical response at point "a" in FIG. 2(*a*), to the backlight luminance response at point "e" in FIG. 2(*c*), then we can obtain the accumulated liquid crystal response at point "b" in FIG. 2(*a*). And this is the lowest accumulated liquid crystal optical response generated by the method and device of the present invention, and it can be designed to reach the sufficiently low level according to the quality and effect of the actual liquid crystal image display desired to attain, and achieving for certain the purpose of eliminating the "after image" overlap blurring between frames on the display screen.

In addition, another important characteristic of the present invention is that the following can be controlled and adjusted by means of controlling the duration of the voltage applied to the backlight unit: (1) starting point of the lowest value of the backlight unit luminance response; (2) the temporal width (namely, length) of the lowest value of the backlight unit luminance response; (3) the depth of the lowest value of the backlight unit luminance response; (4) the starting point of the lowest value of the liquid crystal accumulated optical response; (5) the temporal width (namely, length) of the lowest value of the liquid crystal accumulated optical response; and (6) the depth of the lowest value of the liquid crystal accumulated optical response.

And it must be re-emphasize here that, the lowest value of the liquid crystal accumulated optical response generated by the above-mentioned backlight luminance adjust and control process, is not limited to occur at certain point on the response curve. And the length of the temporal continuation of the lowest value of backlight luminance response can be adjusted by controlling the duration of the applied backlight voltage, so as to enable the lowest value of the liquid crystal molecule optical response to continue for an adjustable interval (for example, the portion of the horizontal linear section between time points A3 and A4 and between time points A6 and A7 as shown in FIG. 2(*a*)). And as such, it can achieve for certain the purpose and effect of eliminating the "after image" overlap blurring between frames. Therefore, in the above-mentioned FIG. 2(*c*), time point is used to illustrate the lowest point of the backlight luminance response; its purpose is only for simplifying the explanation and facilitating the understanding.

In addition, the advantage of backlight units made with LED or EL being superior to those made with CCFL are: its luminance response is of the immediate-target-value mode, and it can immediately reach the nominal luminance target response value as shown in FIG. 2(*d*). Besides, the backlight units made with LED or EL material can have a plurality of sequentially incrementing nominal target values, which can be applied to different designs. However, as for the backlight unit made with CCFL, its luminance response is slower as the gradual-target-value mode as shown in FIG. 2(*c*), and it must take a certain period of time to reach the nominal luminance target response value after the backlight unit being applied the control voltage. Therefore, its contribution to the temporal width of reducing the liquid crystal accumulated optical response to the lowest value is smaller. Besides, in general, the luminance response of CCFL made with one kind of material usually has one nominal target value.

In the following analyses, we will describe in detail the other variations and Embodiments of the device used for eliminating the image overlap blurring between frames in the process of simulating CRT impulse type image display used in the present invention.

The present invention also relates the method used for eliminating the image overlap blurring between frames in the process of simulating CRT impulse type image display.

The various features and advantages of the present invention can be understood more thoroughly through the following detailed description of the Embodiment together with the attached drawings, wherein similar reference numbers are used to represent similar elements.

BRIEF DESCRIPTION OF THE DRAWINGS

The related drawings in connection with the detailed description of the present invention to be made later are described briefly as follows, in which:

FIG. 3(*b*) represents the liquid crystal display simulation driving device according to the first embodiment of the present invention;

FIG. 5(*b*) represents the liquid crystal display simulation driving device according to the second embodiment of the present invention;

FIG. 7(*b*) represents the liquid crystal display simulation driving device according to the third embodiment of the present invention;

FIG. 9(*b*) represents the liquid crystal display simulation driving device according to the fourth embodiment of the present invention;

FIG. 11(*b*) represents the liquid crystal display simulation driving device according to the fifth and sixth embodiments of the present invention;

DETAILED DESCRIPTION OF THE PREFERRED EMBODIMENT

In the following embodiments, the waveforms displayed are mainly used as instruments or tools to describe the voltage applied on the liquid crystal molecule and the backlight unit, and the characteristics and behaviors of the liquid crystal molecule optical response and the backlight unit luminance response. And the features and advantages of the present invention will be explained based on the above descriptions.

In FIGS. 4, 6, 8, 10, 12, and 13 in the following six embodiments, the abscissa indicates time, and its units is millisecond (ms), with A1 to A7 as the sequentially progressing time points; and its ordinate indicates driving voltage, with "code" as its displaying unit. Wherein, for the sake of convenient explanation, in the above-mentioned drawings, the time of the waveform progression on the abscissa can be divided into (N−1)th, Nth, (N+1)th, (N+2)th, etc. equal frame time partitions as units of frame time. And the dotted lines in FIGS. 4(*a*), 6(*a*), 8(*a*), 10(*a*), 12(*a*), and 13(*a*) indicate the optical response (namely, the gray level response) path characteristic curves for the liquid crystal molecules under the application of various different driving voltages. Usually, the optical response is the luminance displayed by the liquid crystal, and with nits (cd/$m^2$) as its unit.

In the following analysis, we will describe the method and device of the present invention in detail by means of the circuit, the relations between the waveform curves of the liquid crystal driving voltage pulse $V_{LC}$, backlight control voltage BV, backlight luminance response BL, and the liquid crystal accumulated optical response Lq as shown in the six respective Embodiments.

Since the purpose and key points of the present invention is to provide "the method and device used for the eliminating the image overlap blurring phenomenon between frames in the process of simulating CRT impulse type image display." Therefore, the emphases in the waveform analysis of the Embodiment of the present invention is on the relation of waveform between the liquid crystal driving voltage pulse $V_{LC}$, backlight control voltage BV, backlight luminance response BL, and the liquid crystal accumulated optical response Lq. However, if the reader would like to know the relations between the waveforms of the control voltage pulse G1, G1', and driving voltage pulses $D_1$, $D_{1'}$, $V_{LC}$, please refer to Taiwan Patent Application No. 98103825, which is another pending application of the present inventor. Therefore, its contents will not be repeated here for brevity's sake.

Figures 2A, 2B, 2C, 2D:
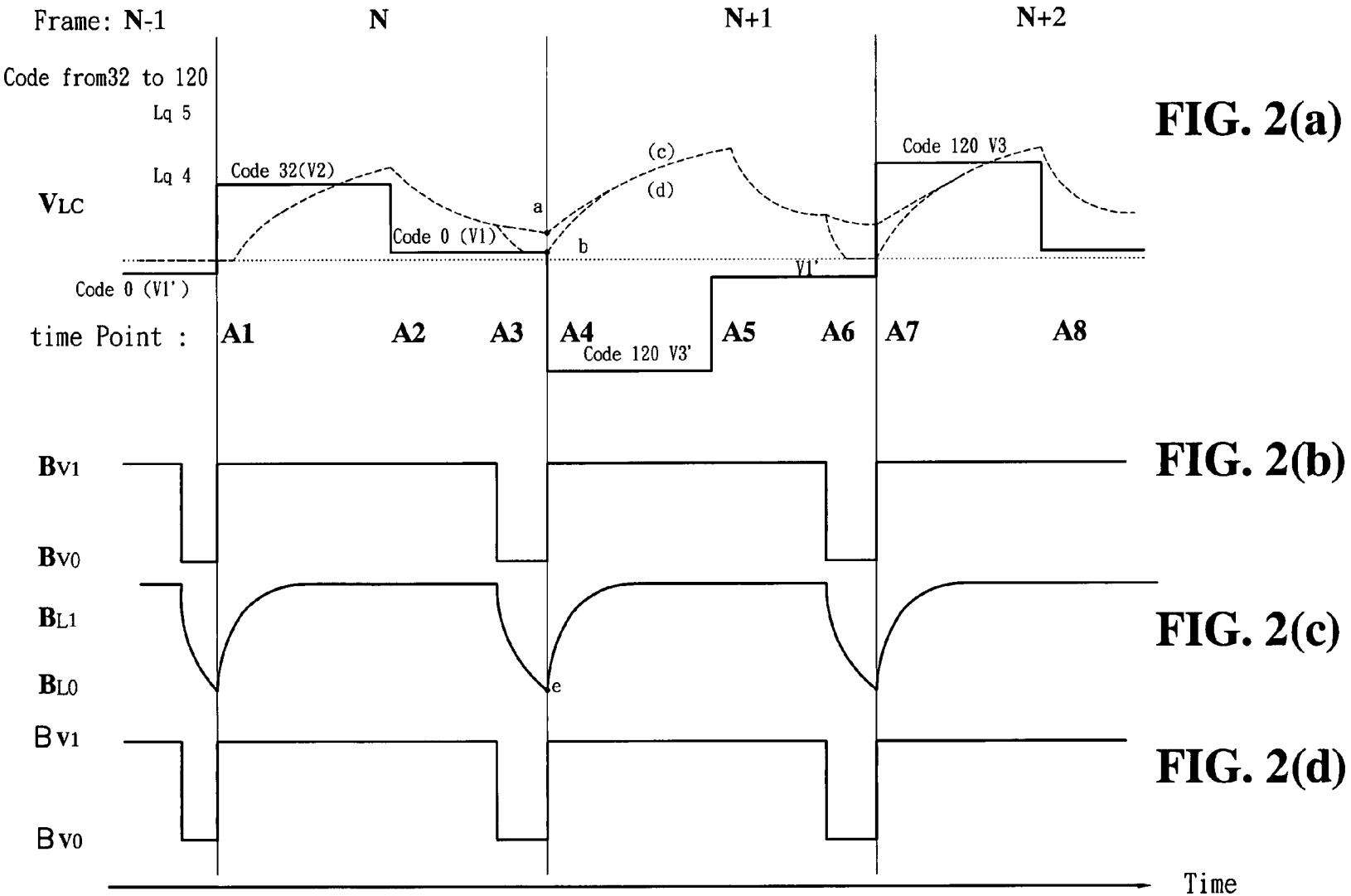
FIGS. 2(*a*) to 2(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the embodiment of the present invention.

In addition, it should emphasized and explained here that the backlight device used in the Embodiment herein utilizes the CCFL as example for illustration, and its optical response is the V-shaped gradual-target-value mode and indicates the phenomenon of time delay. However, the present invention may also utilizes the backlight device made of LED, OLED, PLED, or EL material, which is able to similarly achieve the purpose and effect of "the method and device used for the eliminating the image overlap blurring phenomenon between frames in the process of simulating CRT impulse type image display". But it should be noted that, the luminance response of the backlight device made of the said materials indicates the immediate-target-value mode of U shape deep well (see FIG. 2(*d*)). Therefore, the shape of the waveform of the accumulated liquid crystal optical response is very similar to those with the CCFL as the example in the following Embodiments, though with slight variation. The waveform analysis in the specification is based on using CCFL as the backlight device, however, as to the detailed description and details of the waveform analysis of the accumulated liquid crystal optical response curve induced and generated by the backlight device made of LED, OLED, PLED or EL, the interested reader can easily infer and obtain the related information based on the above description and the waveform analysis of each of the following Embodiments. Therefore, they will not be described in detail here one by one, so as to avoid unnecessarily making the said waveform analyses appear to be too complicated.

Embodiment 1

In the following analysis, please refer to FIGS. 1, 3(*a*), 3(*b*) and 4(*a*)-4(*e*) as we explain first embodiment of the present invention.

Figure 1:
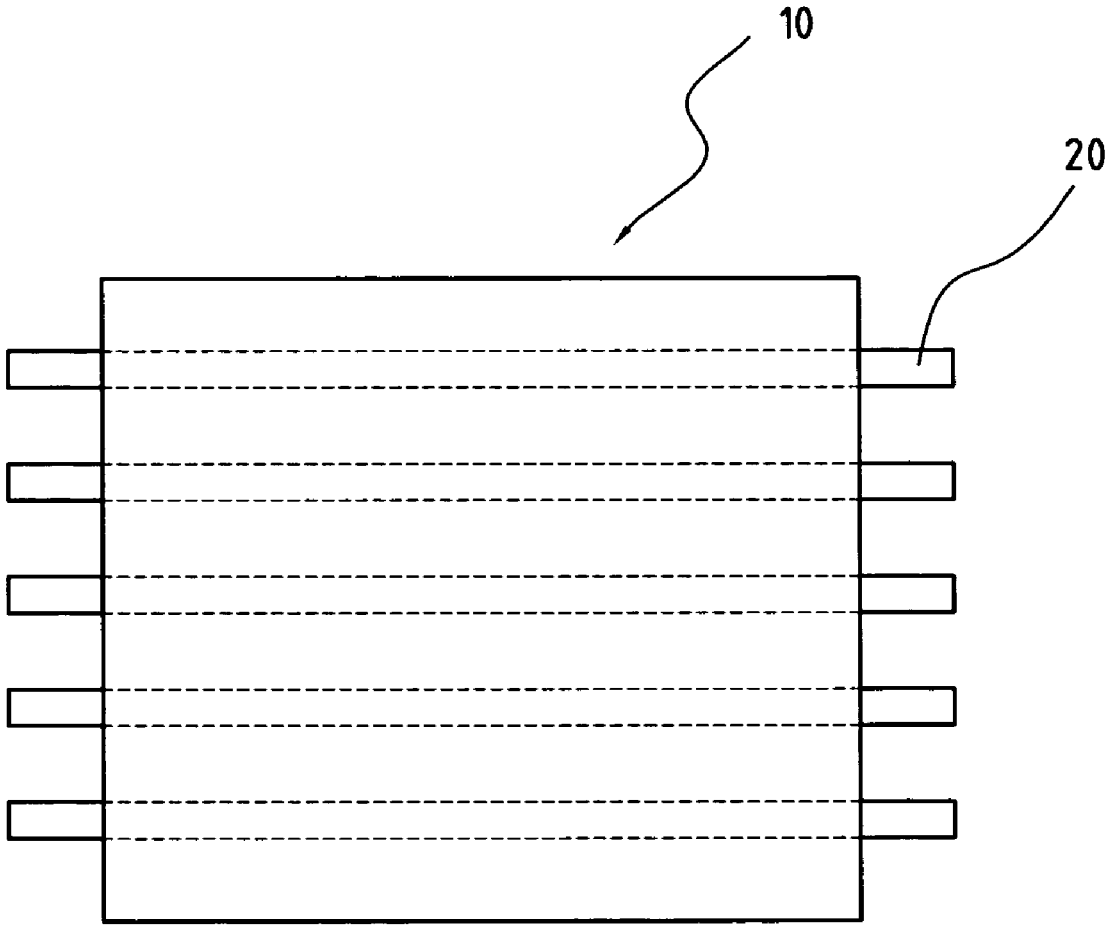
FIG. 1 is a schematic view indicating the structure arrangement of a liquid crystal display panel and backlight unit according to all the embodiments of the present invention.

Referring to FIG. 1, it indicates the structure arrangement of the liquid crystal display panel and backlight unit used according to the first embodiment of the present invention.

Figures 3A, 3B:
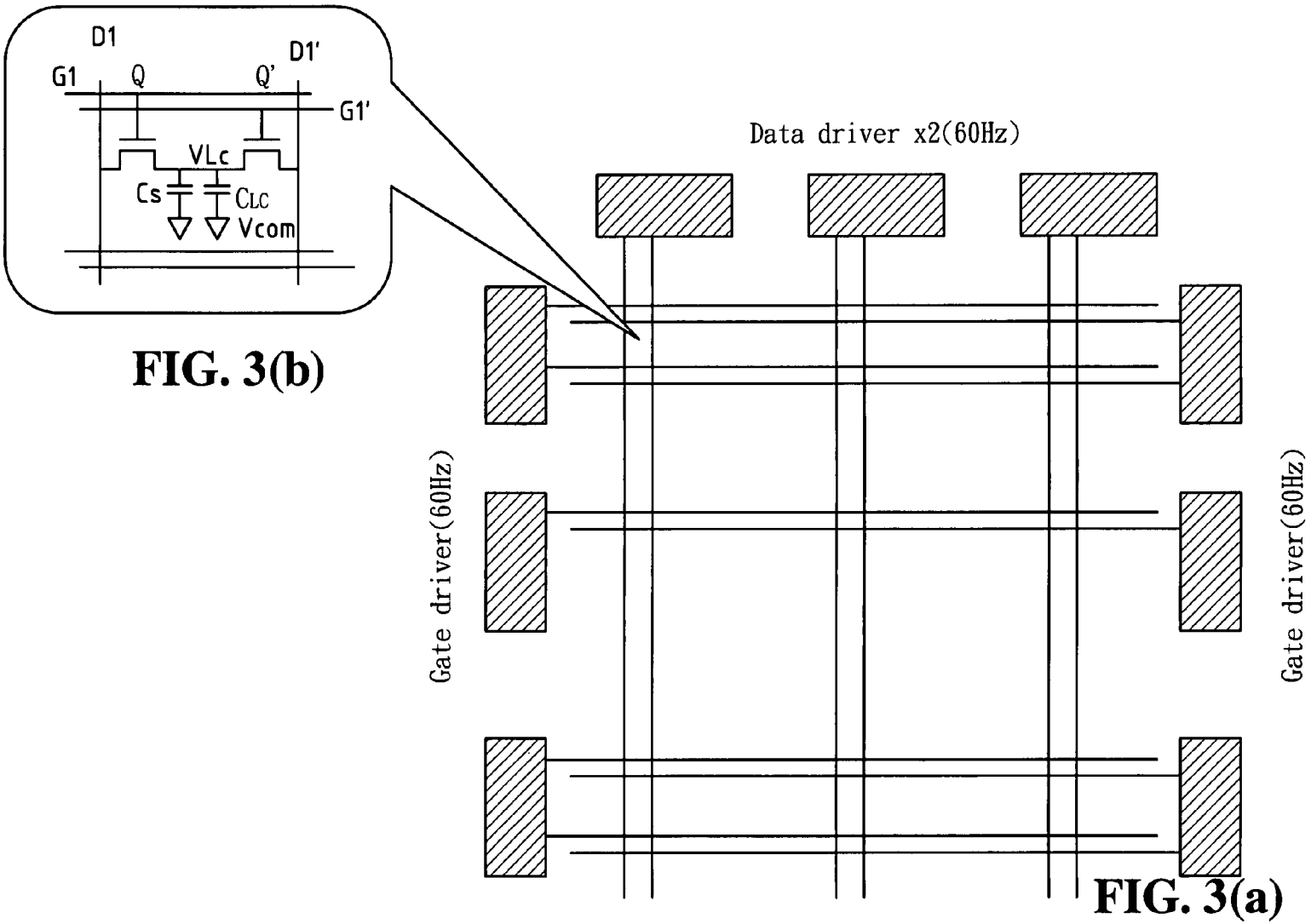
FIG. 3(*a*) is the schematic view indicating the pixel array formed by the cross points of a plurality of gate lines and data lines, and the simulation driving circuit formed by a plurality of data driver and gate driver according to the first embodiment of the present invention.

FIG. 3(*a*) indicates the pixel array formed by the cross points of a plurality of gate lines and data lines, and the simulation driving circuit formed by a plurality of data driver and gate driver according to the first embodiment of the present invention.

FIG. 3(*b*) represents the liquid crystal display simulation driving device according to the first Embodiment.

Figures 4A, 4B, 4C, 4D:
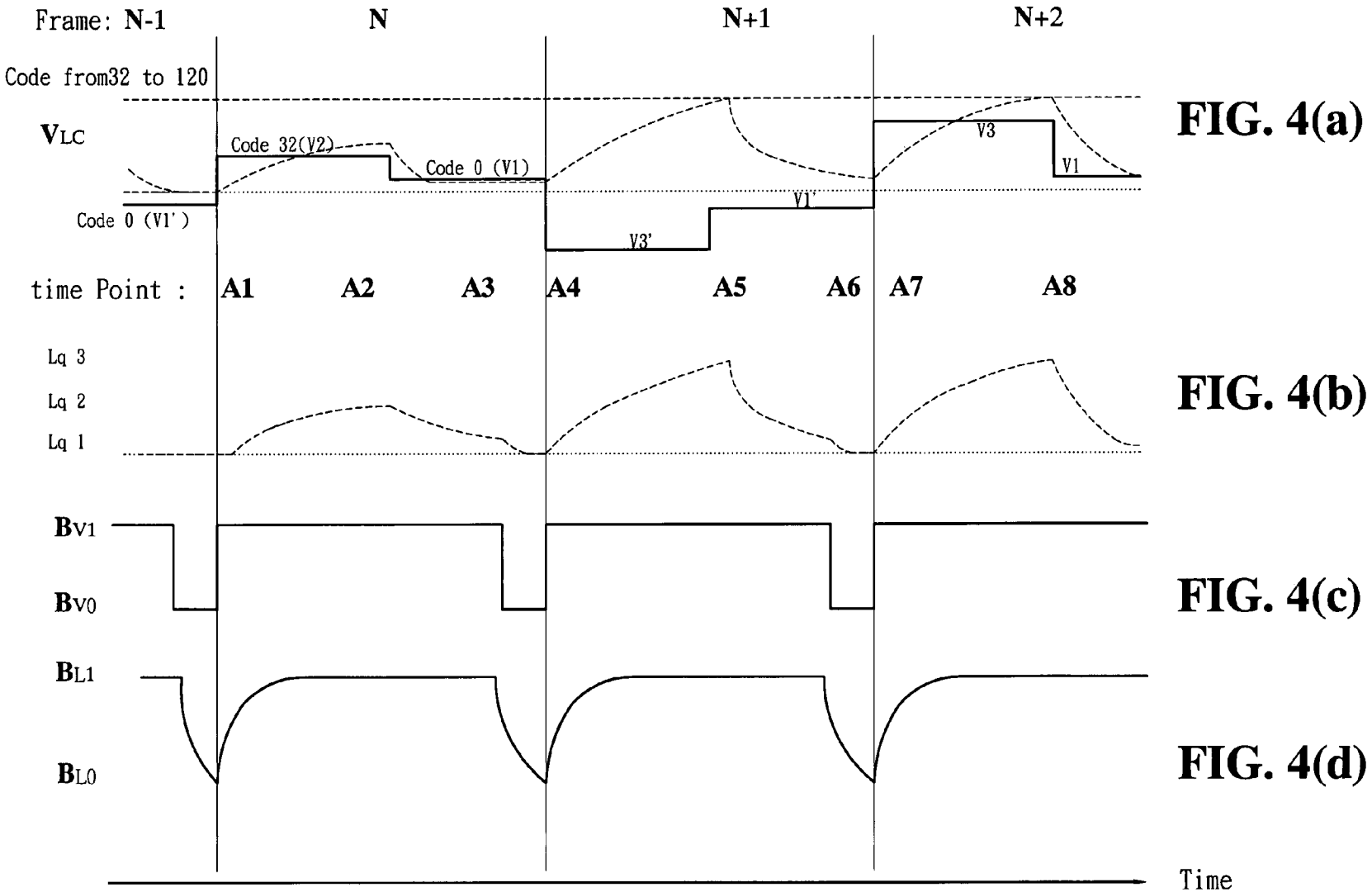
FIGS. 4(*a*) to 4(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the first Embodiment of the present invention.

FIGS. 4(*a*)-4(*d*) indicate the relations of the waveform curves between the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 3(*a*), and 3(*b*) of the present Embodiment.

Image Blurring Elimination Device

According to FIGS. 1, 3(*a*), and 3(*b*), the image blurring elimination device comprises: a first input control line ($G_1$); a second input control line ($G_{1'}$); a first input data line ($D_1$); a second input data line ($D_{1'}$); a first capacitor ($C_S$); a second capacitor ($C_{LS}$); driving voltage output line; a first transistor (Q) comprising a first gate connected to the first input control line ($G_1$), a first source connected to the first input data line ($D_1$), and a first drain connected to the driving voltage output line and the first capacitor ($C_S$) and the drain of the second transistor(Q'); and a second transistor (Q') comprising a second gate connected to the second input control line ($G_{1'}$), a second source connected to the second input data line ($D_{1'}$), a second drain connected to the drain of the first transistor and the second capacitor ($C_{LC}$) and driving voltage output line; wherein the said first capacitor and the said second capacitor are storage capacitor and liquid crystal equivalent capacitor respectively and are connected to ground, and the driving voltage output line is used to output the driving voltage used for simulation to the said pixels of the LCD panel so as to display images, and including backlight unit with adjustable and controllable luminance and backlight input voltage control line; characterized in that the said first and second input control lines are connected to a gate driver, and the said first and second input data lines are connected to a data driver respectively; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Image Blurring Elimination Method

The following is the image blurring elimination method used for the image blurring elimination device according to the first embodiment of the present invention, comprising the following steps: (I) providing the first control signal ($G_1$) with periodic pulse waveforms to the first gate of the first transistor (Q) of the said circuit; (II) providing the second control signal ($G_{1'}$) with periodic pulse waveforms to the second gate of the second transistor (Q') of the said circuit; (III) the second control signal ($G_{1'}$) is the same as the first control signal ($G_1$) except the phase delay; (IV) providing the first data signal ($D_1$) to the source of the first transistor (Q) of the said circuit, when activated by the said first control signal ($G_1$), the said circuit feeds the first data signal ($D_1$) to the said driving voltage output line; (V) providing the second data signal ($D_{1'}$) to the source of the second transistor (Q') of the said circuit, when activated by the said second control signal ($G_{1'}$), the said circuit feeds the second data signal ($D_{1'}$) to the said driving voltage output line; (VI) outputting the said output driving voltages generated by the above steps to the said pixels, so as to display images; and (VII) during the interval of black line scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Waveform Analysis

In the following analysis , please refer to FIGS. 4(*a*) to 4(*d*) as we describe in detail the relations between the waveforms of the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 3(*a*), and 3(*b*) of the present Embodiment.

In the following discussion, the driving voltages $V_1$, $V_2$, and $V_3$ can be considered as a kind of voltage value expressed in "code".

It must be reemphasized here that the said driving voltage can reach its target voltage momentarily, however, the liquid crystal molecules have to take a certain period of response time to reach its optical response target position after being applied the driving voltages. This is due to the intrinsic property of the liquid crystal.

Since usually AC voltage is utilized as the voltage for driving the liquid crystal, therefore, this voltage indicates the phenomenon of alternating positive and negative phases during the control and driving process of the liquid crystal (namely, the waveforms of the pulses of driving voltage $V_{LC}$ will indicate the phenomenon of alternating positive and negative phases relative to the reference voltage $V_{COM}$).

These waveforms proceed sequentially and periodically from time points A1 to A7 repeatedly in the following manner:

Before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and the value of accumulated liquid crystal optical response is Lq1; then at time point A1 the waveform enters into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then time proceeds to time point A2, at this time the value of the driving voltage pulse $V_{LC}$ decreases from $V_2$ (code 32)

to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then to value Lq1 at time point A4; then the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 and remains so until time point A4; then the time proceeds to time point A4, and the waveform enters the (N+1)th frame, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response steadily decreases via time point A6, then later decreases to Lq1 and then remains so until time point A7; then the time proceeds to time point A6, at this time the driving voltage pulse $V_{LC}$ still remains at $V_{1'}$ (code 0) of negative polarity, at this time the value of backlight control voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; then the time proceeds to time point A7 and the waveform start entering (N+2)th frame, and the waveform variations of the driving voltage pulse of the liquid crystal molecules $V_{LC}$, the backlight control voltage BV, backlight luminance response BL, and the accumulated liquid crystal optical response Lq are the same as the waveform variations of those during the (N+1)th frame interval and between time points A4-A7. Therefore, it will not repeated here for brevity's sake. As to the various above variations during the respective frame interval after the (N+2)th frame, they can all be easily inferred and known based on the above explanations.

The dotted line as shown in FIG. 4(*a*) is the liquid crystal optical response characteristic curve produced while performing the simulation drive of CRT image display. When the output driving voltage of the simulation device between each time point is code 0 as shown in the figure, this means that the black line scanning is performed on the display screen during this period, and by doing so, it can achieve the same results as inserting black frame. In addition, the luminance of the backlight unit is appropriately reduced by means of the design of the present invention, so as to enable the minimization of the accumulated liquid crystal optical response Lq, as such ensuring the elimination of the phenomenon of the "after image" overlap blurring between frames, and thus indeed achieving the purpose of simulating the CRT display impulse type image display with LCD display. And this is the most important advantage of the present invention over prior art.

Embodiment 2

In the following analyses, please refer to FIGS. 1, 5(*a*), 5(*b*) and (*a*) to 6(*d*) as we explain second embodiment of the present invention.

First, please refer to FIG. 1, it indicates the structure arrangement of the liquid crystal display panel and backlight unit used according to the second embodiment of the present invention.

Figures 5A, 5B:
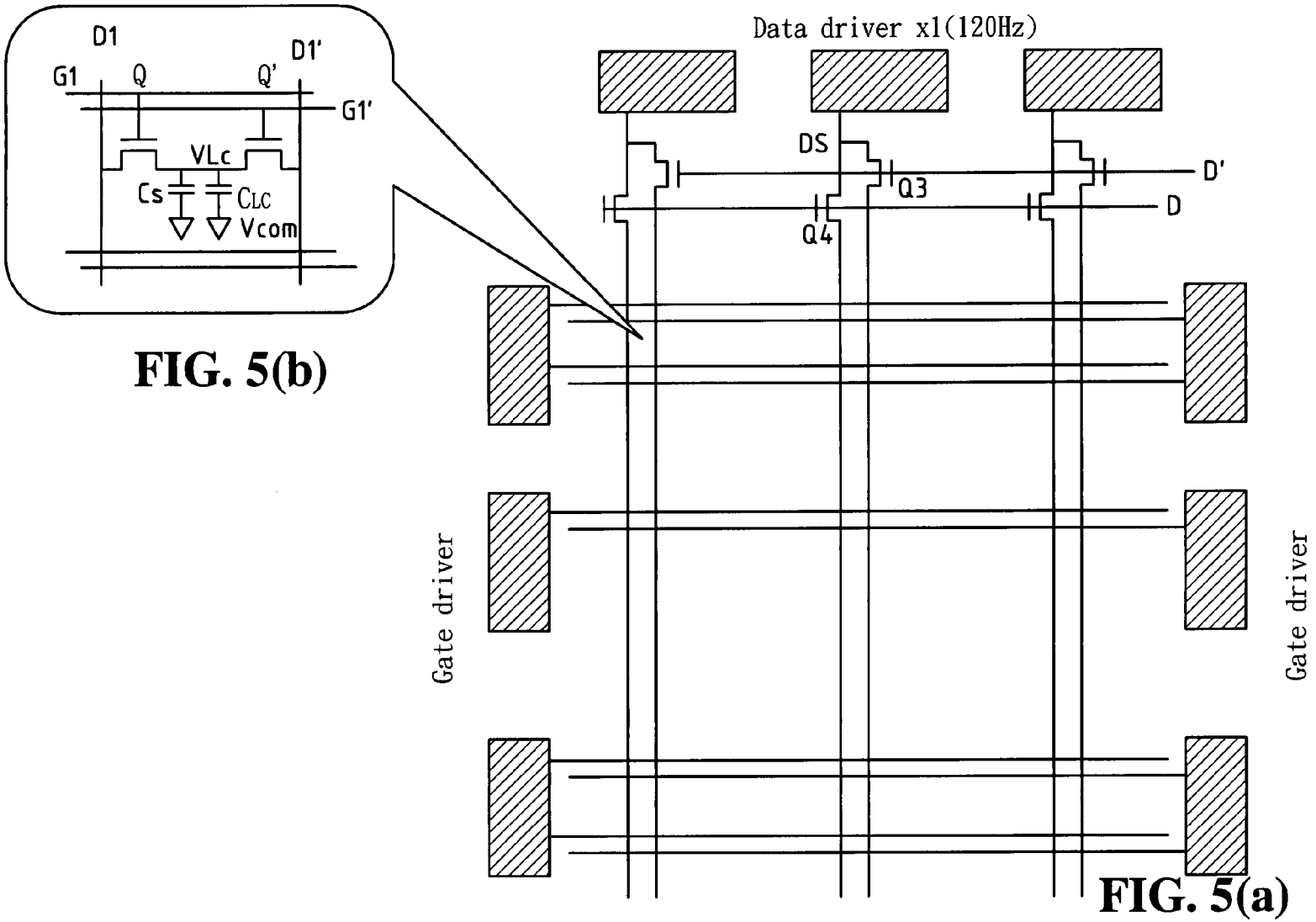
FIG. 5(*a*) is a schematic diagram indicating the pixel array formed by the cross points of a plurality of gate lines and data lines, and the simulation driving circuit formed by a plurality of data driver and gate driver according to the second embodiment of the present invention.

FIG. 5(*a*) indicates the pixel array formed by the cross points of a plurality of gate lines and data lines, and the simulation driving circuit formed by a plurality of data driver and gate driver according to the second embodiment of the present invention.

FIG. 5(*b*) represents the liquid crystal display simulation driving device according to the second embodiment.

Figures 6A, 6B, 6C, 6D:
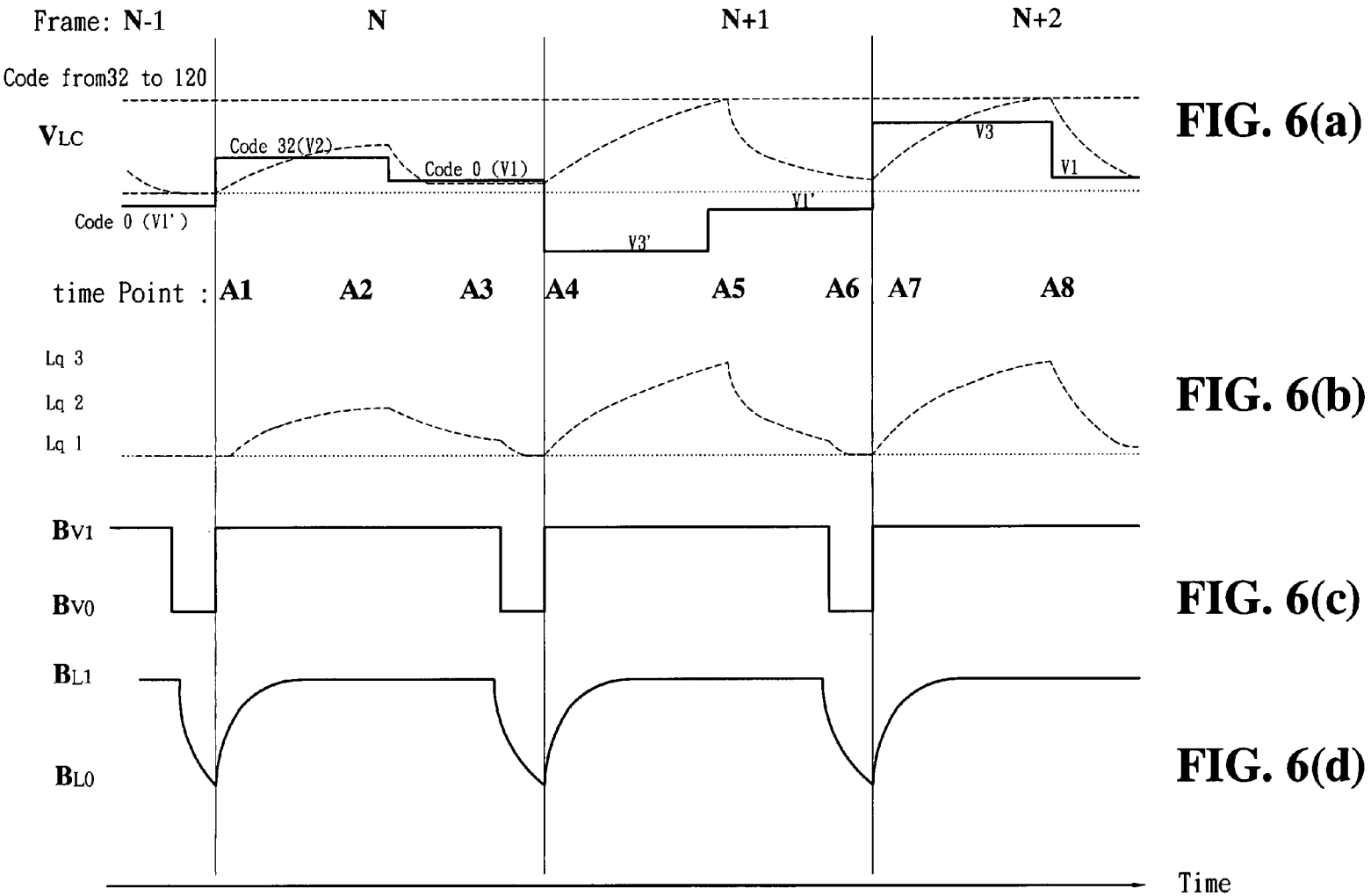
FIGS. 6(*a*) to 6(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the second Embodiment of the present invention.

FIGS. 6(*a*) to 6(*d*) indicate the relations of the waveform curves between the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 5(*a*), and 5(*b*) of the second Embodiment.

Image Blurring Elimination Device

According to FIGS. 1, 5(*a*), and 5(*b*), the image blurring elimination device of the second embodiment comprises: a first input control line($G_1$); a second input control line ($G_{1'}$); a first input data line ($D_1$); a second input data line ($D_{1'}$); a third input data line (D'); a fourth input data line (D); a fifth input data line ($D_S$); a first capacitor ($C_S$); a second capacitor ($C_{LS}$); a third transistor(Q3); a fourth transistor(Q4); driving voltage output line; a first transistor(Q) comprising a first gate connected to the first input control line ($G_1$), a first source connected to the input data line ($D_1$), and a first drain connected to the driving voltage output line and the first capacitor ($C_S$) and the drain of the second transistor(Q'); a second transistor(Q') comprising a second gate connected to the second input control line ($G_{1'}$), a second source connected to the second input data line ($D_{1'}$), a second drain connected to the drain of the said first transistor and the second capacitor ($C_{LC}$) and driving voltage output line; wherein the said first capacitor and the said second capacitor are storage capacitor and liquid crystal equivalent capacitor respectively and are connected to ground, and the driving voltage output line is used to output the driving voltage used for simulation to the said pixels of the LCD panel so as to display images, and including backlight unit with adjustable and controllable luminance and backlight input voltage control line; characterized in that the said first and second input control lines are connected to a gate driver, and the said first and second input data lines (D1, D1') are connected to the drains of two another switching transistors (Q3, Q4) connected in parallel, the sources of the said two switching transistors connected in parallel are connected to a data driver, with its gate connected to the third and fourth input data lines (D', D); and the time difference between the periodic pulse waveforms of the said first and second control signals (G1, G1') is the time difference across n scanning lines generated by n pulses, and which can be adjusted; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Image Blurring Elimination Method

The following is the image blurring elimination method used for the image blurring elimination device according to the second embodiment of the present invention, comprising the following steps: (I) providing the first control signal ($G_1$) with periodic pulse waveforms to the first gate of the first transistor of the said circuit; (II) providing the second control signal ($G_{1'}$) with periodic pulse waveforms to the second gate of the second transistor of the said circuit, the second control signal ($G_{1'}$) being the same as the first control signal ($G_1$) except the phase delay; (III) providing the fifth data signal (Ds) to the sources of the third transistor (Q3) and fourth transistor (Q4) connected in parallel; (IV) providing the third data signal (D') to the gate of the third transistor (Q3); (V) providing the voltage pulse generated by the drain of the third transistor to the source of the first transistor (Q1) as the first data signal (D1), when the said first transistor (Q1) is activated by the first control signal (G1), the first data signal (D1) is fed by the said circuit to the driving voltage output line; (VI) providing the fourth data signal (D) to the gate of the fourth transistor (Q4); (VII) providing the voltage pulse generated by the drain of the fourth transistor to the source of the second transistor (Q') as the second data signal (D1'), when the said second transistor (Q') is activated by the second control signal (G1'), the second data signal (D1') is fed by the said circuit to the driving voltage output line; (VIII) outputting the said output driving voltage generated by the above steps to the said pixels so as to display images; and (IX) during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Waveform Analysis

In the following analysis, please refer to FIGS. 6(*a*) to 6(*d*) as we describe in detail the relations between the waveforms of the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 5(*a*), and 5(*b*) of the present Embodiment.

Since the description relating to the process of waveform progression of the present Embodiment is the same as that of Embodiment 1, please refer to the contents of "the waveform analysis" of Embodiment 1 for its clear and complete understanding, and it will not be repeated here for brevity's sake.

The dotted line as shown in FIG. 6(*a*) is the liquid crystal optical response characteristic curve produced while performing the simulation drive of CRT image display. When the output driving voltage of the simulation device between each time point is code 0 as shown in the figure, this means that the black line scanning is performed on the display screen during this period, and by doing so, it can achieve the same results as inserting black frame. In addition, the luminance of the backlight unit is appropriately reduced by means of the present invention, so as to enable the minimization of the accumulated liquid crystal optical response Lq, as such ensuring the elimination of the phenomenon of the "after image" overlap blurring between frames, and indeed achieving the purpose of simulating the CRT display impulse type image display with LCD display. And this is the most important advantage of the present invention over prior art.

For the sake of easy and convenient explanation and understanding, the waveform of the driving voltage pulse of the liquid crystal molecules $V_{LC}$, the backlight control voltage BV, backlight luminance response BL, and the accumulated liquid crystal optical response Lq output by the image blurring elimination device of the present Embodiment as shown above is the same as those of Embodiment 1, so as to avoid it being too complicated to understand in the process of explanation. However, the waveform can be designed to have various variations according to the actual requirements of the LCD display.

Embodiment 3

In the following analyses, please refer to FIGS. 1, 7(*a*), 7(*b*) and 8(*a*) to 8(*d*) as we explain third embodiment of the present invention.

First, please refer to FIG. 1, its indicates the structure arrangement of the liquid crystal display panel and backlight unit used according to the third embodiment of the present invention.

Figures 7A, 7B:
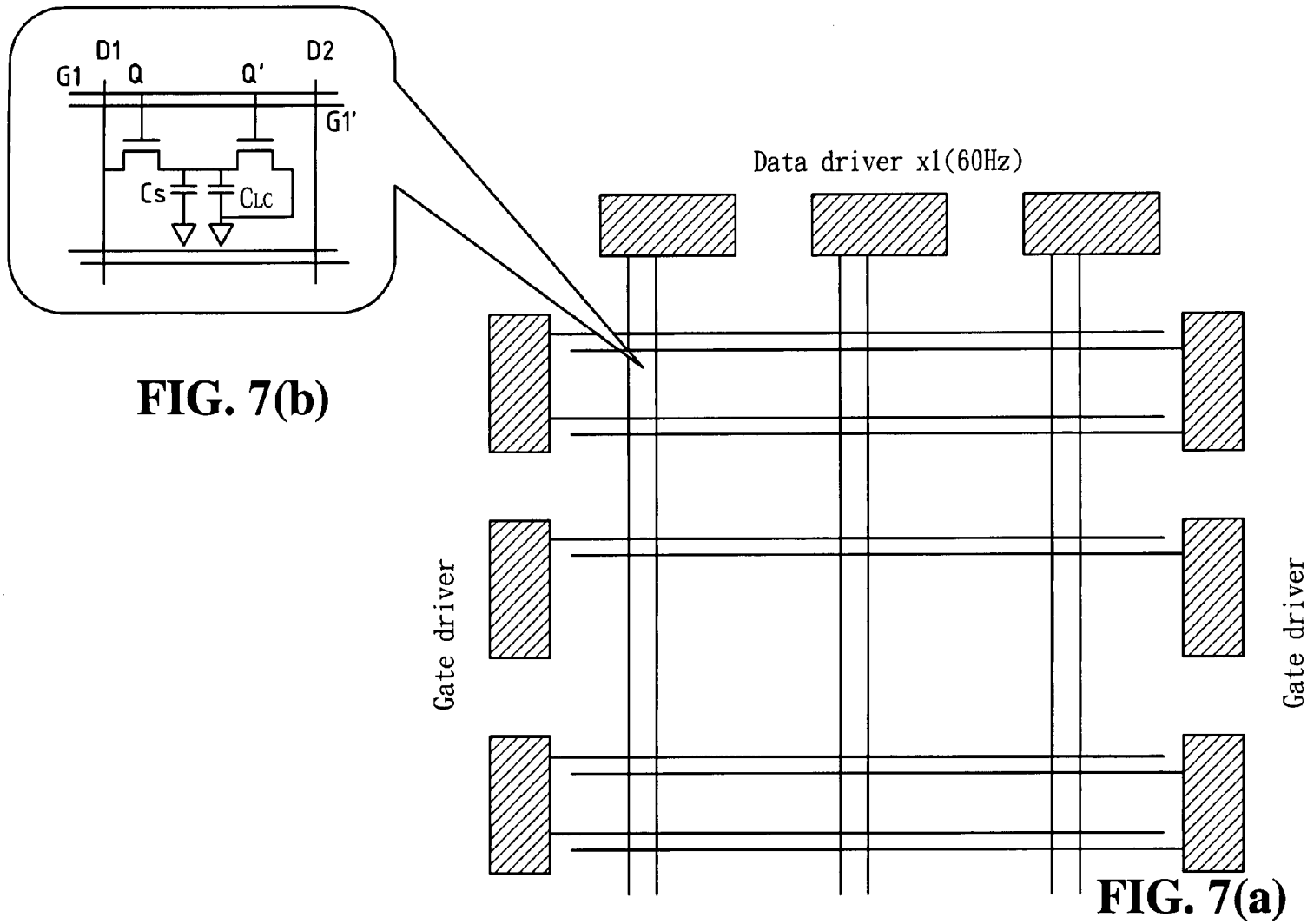
FIG. 7(*a*) is the schematic diagram indicating the pixel array formed by the cross points of a plurality of gate lines and data lines, and the simulation driving circuit formed by a plurality of data driver and gate driver according to the third embodiment of the present invention.

FIG. 7(*a*) indicates the pixel array formed by the cross points of a plurality of gate lines and data lines, and the simulation driving circuit formed by a plurality of data driver and gate driver according to the third embodiment of the present invention.

FIG. 7(*b*) represents the liquid crystal display simulation driving device according to the third embodiment.

Figures 8A, 8B, 8C, 8D:
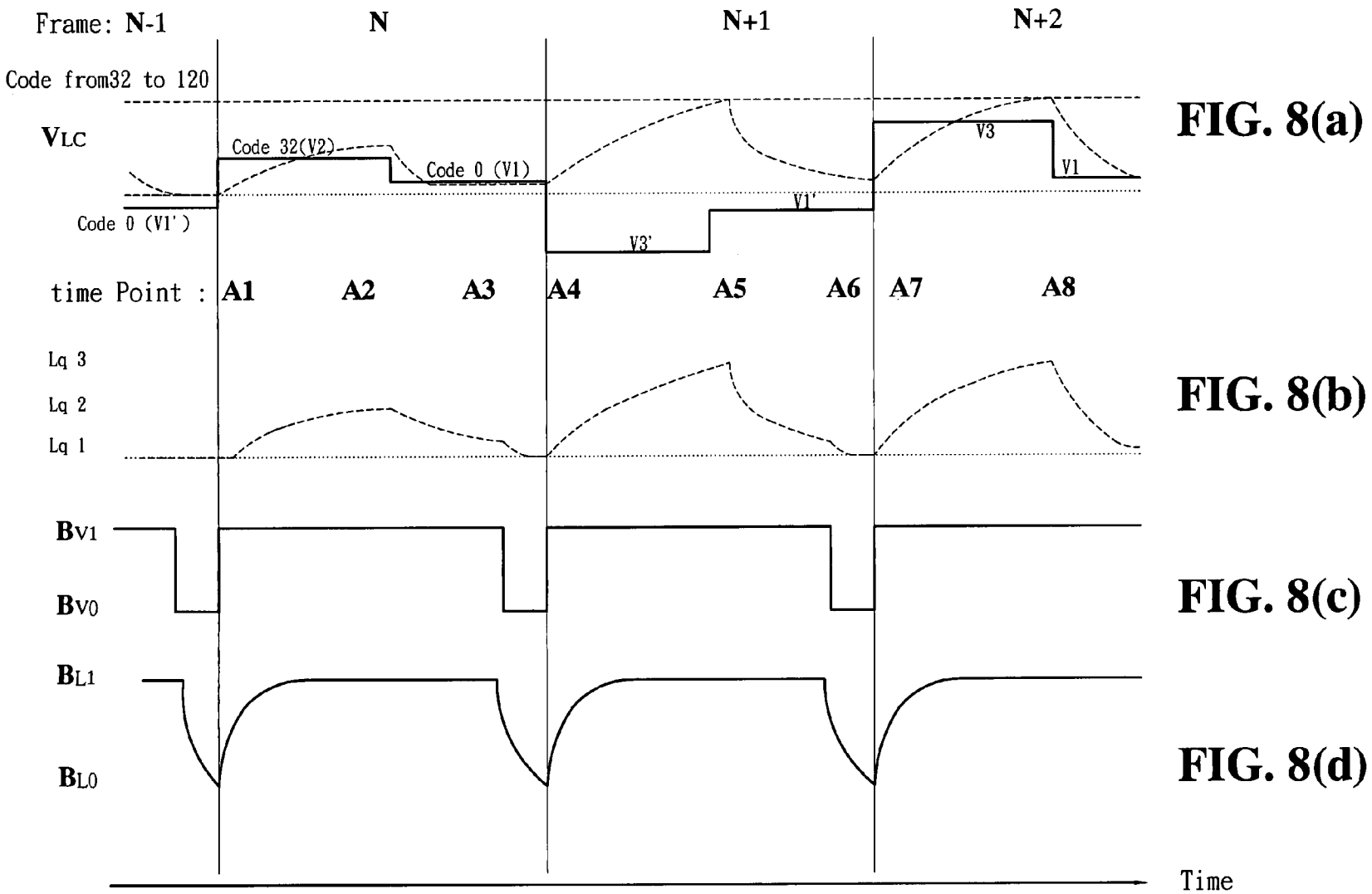
FIGS. 8(*a*) to 8(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the third Embodiment of the present invention.

FIGS. 8(*a*) to 8(*d*) indicate the relations of the waveform curves between the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 7(*a*), and 7(*b*) of the third Embodiment.

Image Blurring Elimination Device

According to FIGS. 1, 7(*a*), and 7(*b*), the image blurring elimination device comprises: a first input control line($G_1$); a second input control line ($G_{1'}$); a first input data line ($D_1$); a first capacitor ($C_S$); a second capacitor ($C_{LS}$); driving voltage output line; a first transistor(Q) comprising a first gate connected to the first input control line ($G_1$), a first source connected to the first input data line ($D_1$), and a first drain connected to the driving voltage output line and the first capacitor ($C_S$) and the second drain of the second transistor(Q'); a second transistor(Q') comprising a second gate connected to the second input control line ($G_{1'}$), a second source connected to ground, a second drain connected to the drain of the said first transistor and the second capacitor ($C_{LC}$) and driving voltage output line; wherein the said first capacitor and the said second capacitor are storage capacitor and liquid crystal equivalent capacitor respectively and are connected to ground, and the driving voltage output line is used to output the driving voltage used for simulation to the said pixels of the LCD panel so as to display images, and including backlight unit with adjustable and controllable luminance and backlight input voltage control line; and characterized in that the said first and second input control lines are connected to a gate driver, and the said first input data line is connected to a data driver; and the time difference between the waveforms of the periodic pulses of the first and second control signals is the time difference across n scanning lines generated by n pulses, and which can be adjusted; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Blurring Image Elimination Method

The following is the image blurring elimination method used for the image blurring elimination device according to the third embodiment of the present invention, comprising the following steps: (I) providing the first control signal ($G_1$) with periodic pulse waveforms to the first gate of the first transistor (Q) of the said circuit; (II) providing the second control signal ($G_{1'}$) with periodic pulse waveforms to the second gate of the second transistor (Q') of the said circuit, the second control signal ($G_{1'}$) being the same as the first control signal ($G_1$) except the phase delay; (III) providing the first data signal ($D_1$) to the source of the first transistor (Q) of the said circuit, when activated by the said first control signal ($G_1$), the said circuit feeds the first data signal ($D_1$) to the said driving voltage output line; (IV) when activated by the second control signal ($G_{1'}$), the ground potential voltage (code 0) is fed by the said circuit to the driving voltage output line; (V) outputting the said output driving voltages generated by the above steps to the said pixels so as to display images; and (VI) during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Waveform Analysis

In the following analysis, please refer to FIGS. 6(*a*) to 6(*d*) as we describe in detail the relations between the waveforms of the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 5(*a*), and 5(*b*) of the present Embodiment.

Since the description relating to the process of waveform progression of the present Embodiment is the same as that of Embodiment 1, please refer to the contents of "the waveform analysis" of Embodiment 1 for its clear and complete understanding, and it will not be repeated here for brevity's sake.

The dotted line as shown in FIG. 8(*a*) is the liquid crystal optical response characteristic curve produced while performing the simulation drive of CRT image display. When the output driving voltage of the simulation device between each time point is code 0 as shown in the figure, this means that the black line scanning is performed on the display screen during this period, and by doing so, it can achieve the same results as inserting black frames. In addition, the luminance of the backlight unit is appropriately reduced by the design of the present invention, so as to enable the minimization of the accumulated liquid crystal optical response Lq, as such ensuring the elimination of the phenomenon of the "after image" overlap blurring between frames, and indeed achieving the purpose of simulating the CRT display impulse type image display with LCD display. And this is the most important advantage of the present invention over prior art.

For the sake of easy and convenient explanation and understanding, the waveform of the driving voltage pulse of the liquid crystal molecules $V_{LC}$, the backlight control voltage BV, backlight luminance response BL, and the accumulated liquid crystal optical response Lq output by the image blurring elimination device of the present Embodiment as shown above is the same as those of Embodiment 1, so as to avoid it being too complicated to understand in the process of explanation. However, the waveform can be designed to have various variations according to the actual requirements of the LCD display.

Embodiment 4

In the following analyses, please refer to FIGS. 1, 9(*a*), 9(*b*) and 10(*a*) to 10(*d*) as we explain fourth embodiment of the present invention.

First, please refer to FIG. 1, its indicates the structure arrangement of the liquid crystal display panel and backlight unit used according to the fourth embodiment of the present invention.

Figures 9A, 9B:
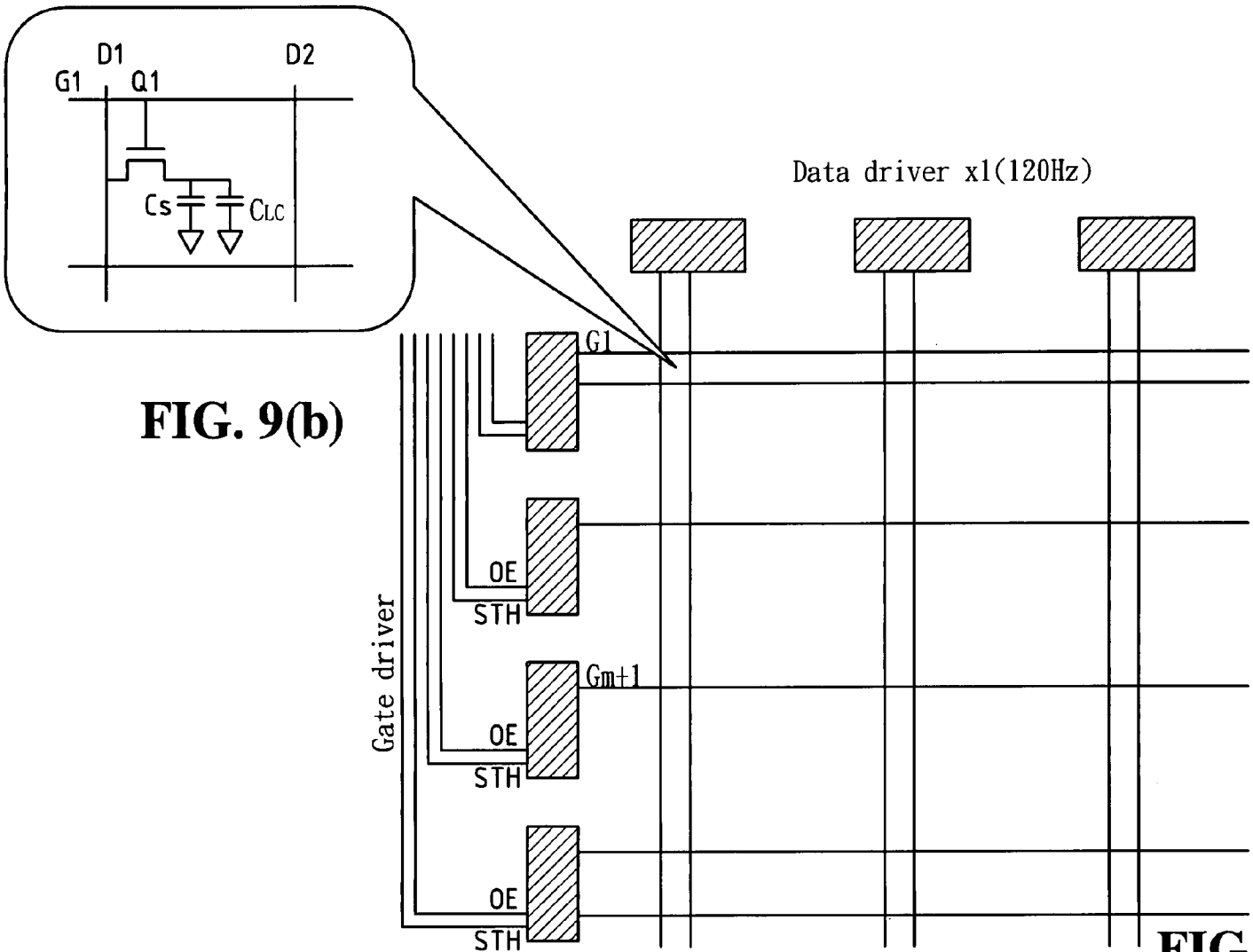
FIG. 9(*a*) is the schematic diagram indicating the pixel array formed by the cross points of a plurality of gate lines and data lines, and the simulation driving circuit formed by a plurality of data driver and gate driver according to the fourth embodiment of the present invention.

FIG. 9(*a*) indicates the pixel array formed by the cross points of a plurality of gate lines and data lines, and the simulation driving circuit formed by a plurality of data driver and gate driver according to the fourth embodiment of the present invention.

FIG. 9(*b*) represents the liquid crystal display simulation driving device according to the fourth embodiment.

Figures 10A, 10B, 10C, 10D:
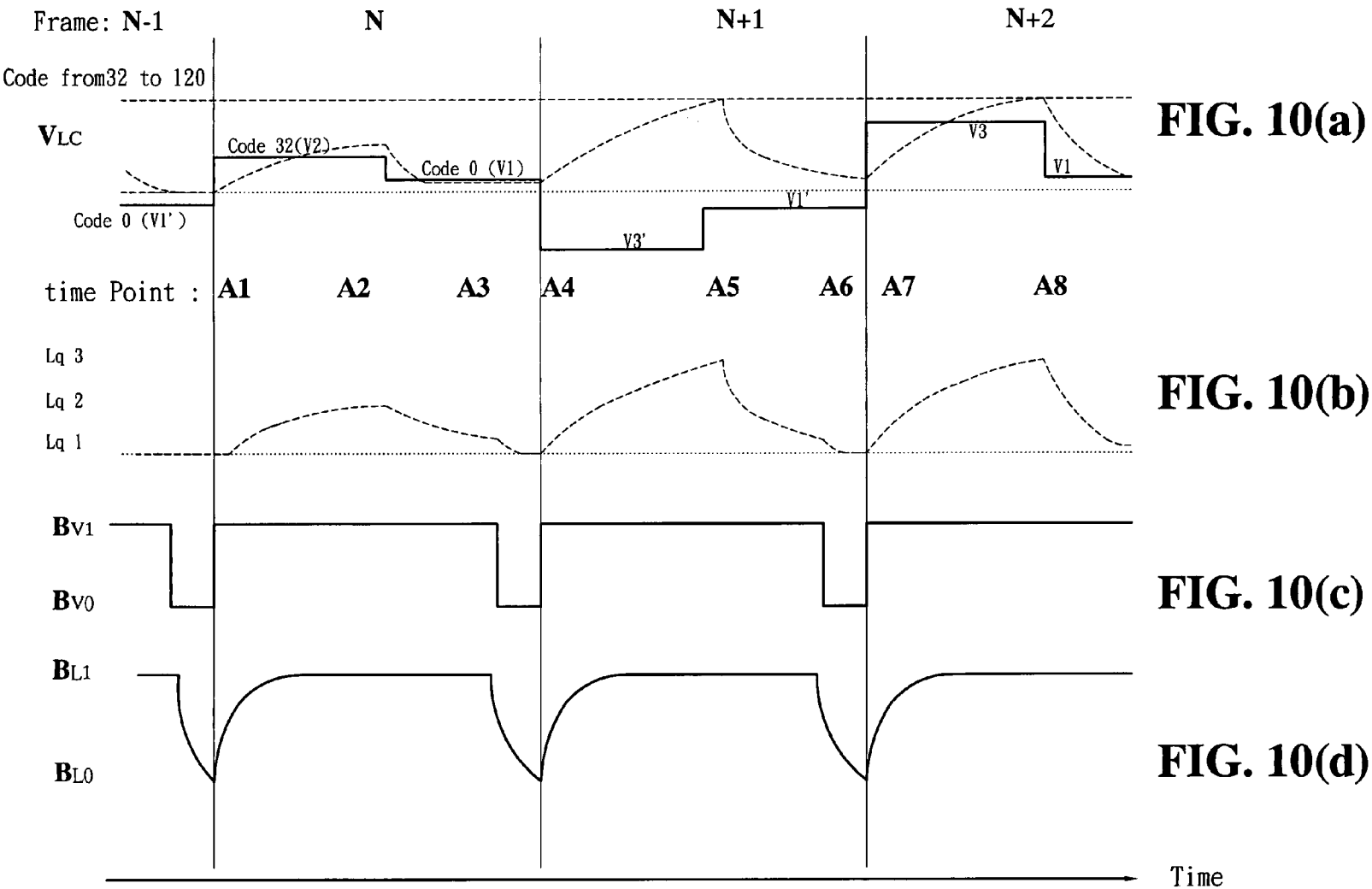
FIGS. 10(*a*) to 10(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the fourth Embodiment of the present invention.

FIGS. 10(*a*) to 10(*d*) indicate the relations of the waveform curves between the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 9(*a*), and 9(*b*) of the fourth Embodiment.

Image Blurring Elimination Device

According to FIGS. 1, 9(*a*), and 9(*b*) the image blurring elimination device of the fourth Embodiment comprises: a first input control line($G_1$); a second input control line ($G_m$); a first input data line ($D_1$); a first capacitor ($C_S$); a second capacitor ($C_{LS}$); a driving voltage output line; and a first transistor(Q1) comprising a gate connected to the first input control line ($G_1$) or the second input control line ($G_m$), a source connected to the input data line ($D_1$), and a drain connected to the driving voltage output line and two capacitors ($C_S$, $C_{LS}$) connected in parallel; wherein the said first capacitor and second capacitor are connected to ground, and the driving voltage output line is used to output the driving voltage used for simulation to the said pixels of the LCD panel so as to display images, and including backlight unit with adjustable and controllable luminance and backlight input voltage control line; and characterized in that the said input data line is connected to a data driver, the said input control line is connected to the gate driver, the said gate driver contains: an output enable (OE) input line and a start pulse horizontal (STH) input line and receives the related signals via the said input lines, so as to generate the synchronous control voltage pulses $G_1$, $G_m$ of the said input control lines, and supplying them to the gate of the said transistor via the first and second input control lines, and generating the driving voltage pulse $V_{LC}$ through its control, and then be able to generate two synchronous scanning lines separated by m scanning lines on the display screen simultaneously, so as to display images; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Image Blurring Elimination Method

The following is the image blurring elimination method used for the image blurring elimination device according to the fourth embodiment of the present invention, comprising the following steps: (I) providing the data signal (D1) with periodic pulse waveform to the source of the said first transistor (Q1); (II) providing control signals OE and STH to the gate driver, so as to generate the synchronous control signals G1, Gm by the said gate driver and providing them to the gate of the said transistor (Q1) via the first and second input control lines; (III) when activated by the said synchronous control signals G1,Gm, the said circuit feeds the said data signal to the said driving voltage output line; (IV) outputting the said output driving voltage generated by the above steps to the said pixels so as to display images; and (V) during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Waveform Analysis

In the following analysis, please refer to FIGS. 10(*a*) to 10(*d*) as we describe in detail the relations between the waveforms of the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 9(*a*), and 9(*b*) of the fourth Embodiment.

Since the description relating to the process of waveform progression of the fourth Embodiment is the same as that of Embodiment 1, please refer to the contents of "the waveform analysis" of Embodiment 1 for its clear and complete understanding, and it will not be repeated here for brevity's sake.

The dotted line as shown in FIG. 10(*a*) is the liquid crystal optical response characteristic curve produced while performing the simulation drive of CRT image display. When the output driving voltage of the simulation device between each time point is code 0 as shown in the figure, this means that the black line scanning is performed on the display screen during this period, and by doing so, it can achieve the same results as inserting black frames. In addition, the luminance of the backlight unit is appropriately reduced by means of the design of the present invention, so as to enable the minimization of the accumulated liquid crystal optical response Lq, as such ensuring the elimination of the phenomenon of the "after image" overlap blurring between frames, and indeed achieving the purpose of simulating the CRT display impulse type image display with LCD display. And this is the most important advantage of the present invention over prior art.

For the sake of easy and convenient explanation and understanding, the waveform of the driving voltage pulse of the liquid crystal molecules $V_{LC}$, the backlight control voltage BV, backlight luminance response BL, and the accumulated liquid crystal optical response Lq output by the image blurring elimination device of the fourth Embodiment as shown above is the same as that of Embodiment 1, so as to avoid it being too complicated to understand in the process of explanation. However, the waveform can be designed to have various variations according to the actual requirements of the LCD display.

Embodiment 5

Figures 11A, 11B:
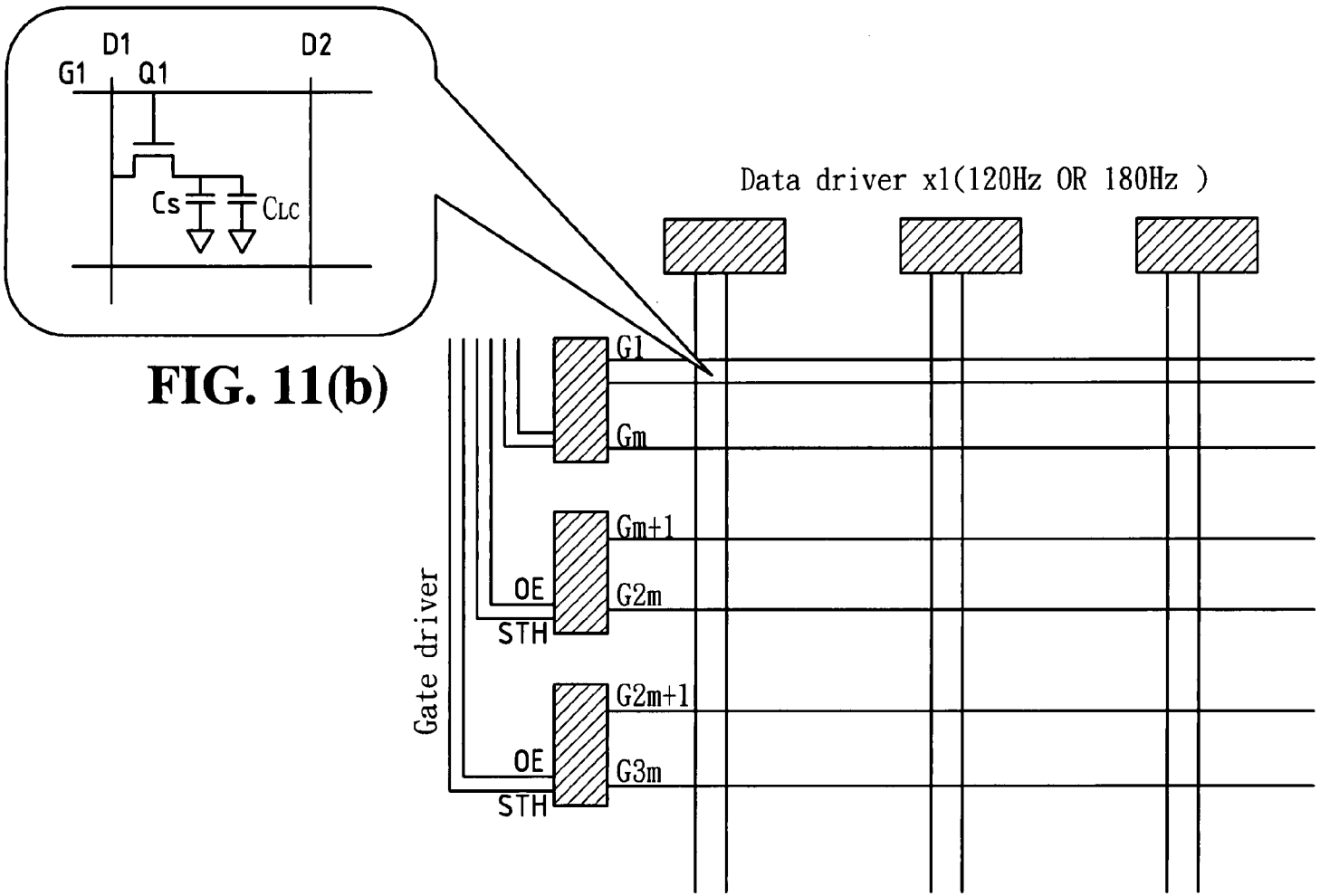
FIG. 11(*a*) is the schematic diagram indicating the pixel array formed by the cross points of a plurality of gate lines and data lines, and the simulation driving circuit formed by a plurality of data driver and gate driver according to the fifth and sixth embodiments of the present invention.

In the following, please refer to FIGS. 11(*a*), 11(*b*) and 12(*a*) to 12(*d*) as we explain the fifth embodiment of the present invention. FIGS. 11(*a*) and 11(*b*) are used to describe the fifth Embodiment and the subsequent sixth Embodiment of the present invention, its purpose is to indicate that different image display effects can be achieved on the display screen by utilizing different control methods with the same device, and this characteristic will be discussed as follows.

Please refer to FIGS. 1, 11(*a*), 11(*b*) and 12(*a*) to 12(*d*) as we explain the fifth embodiment of the present invention.

First, please refer to FIG. 1, its indicates the structure arrangement of the liquid crystal display panel and backlight unit used according to the fifth embodiment of the present invention.

FIG. 11(*a*) indicates the pixel array formed by the cross points of a plurality of gate lines and data lines, and the simulation driving circuit formed by a plurality of data driver and gate driver according to the fifth embodiment of the present invention.

FIG. 11(*b*) represents the liquid crystal display driving simulation driving device according to the fifth embodiment.

Figures 12A, 12B, 12C, 12D:
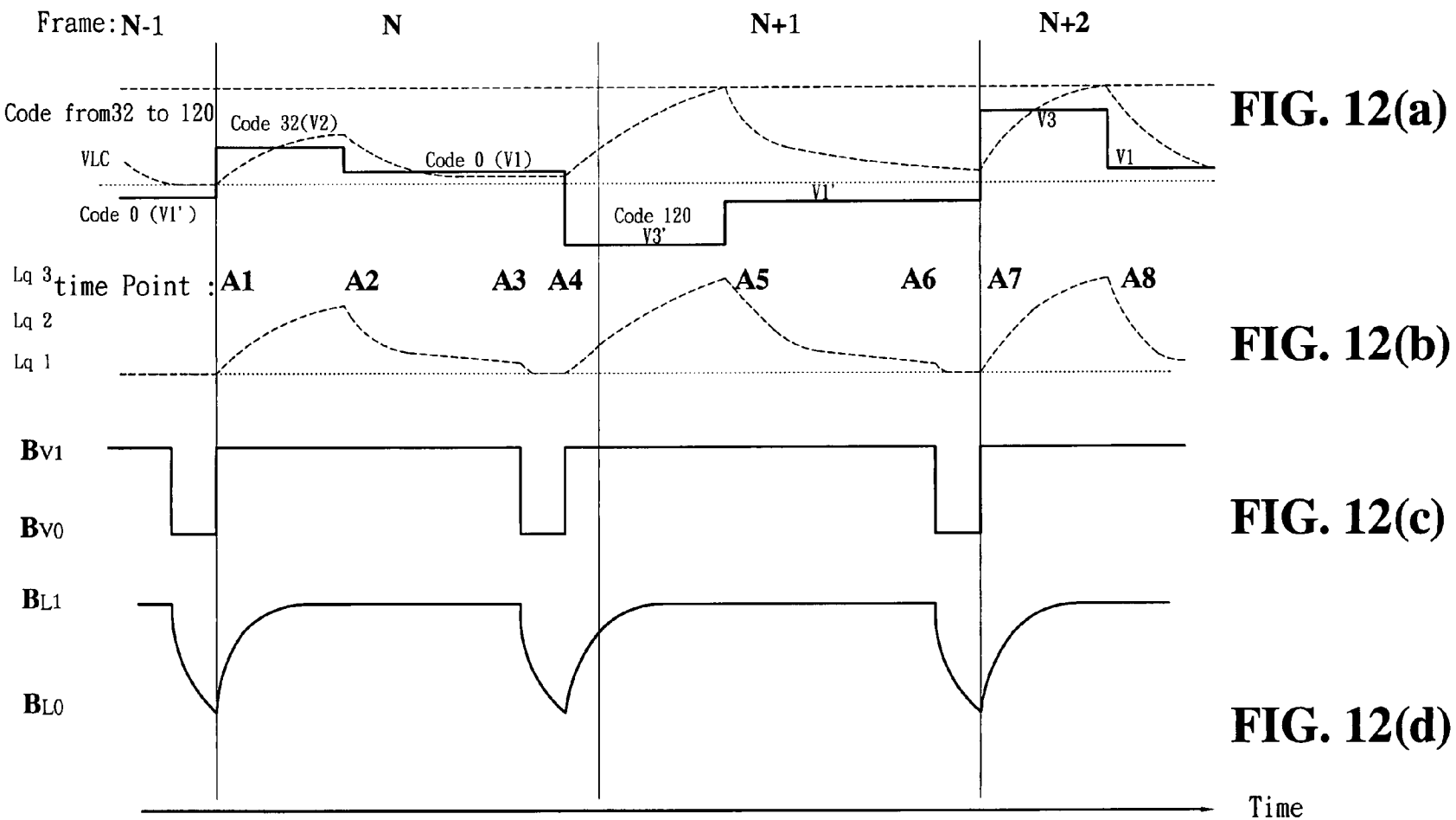
FIGS. 12(*a*) to 12(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the fifth Embodiment of the present invention.

FIGS. 12(*a*) to 12(*d*) indicate the relations of the waveform curves between the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 11(*a*), and 11(*b*) of the fifth Embodiment.

Image Blurring Elimination Device

According to FIGS. 1,11(*a*), and 11(*b*), the image blurring elimination device of the fifth Embodiment comprises: a first input control line($G_1$); a second input control line ($G_{m+1}$); a third input control line ($G_{2m+1}$); a first input data line ($D_1$); a first capacitor ($C_S$); a second capacitor ($C_{LS}$); and a driving voltage output line; and a first transistor(Q) comprising a gate connected to the first input control line ($G_1$) or the second input control line ($G_{m+1}$) or the third input control line ($G_{2m+1}$); a source connected to the first input data line ($D_1$), and a drain connected to the driving voltage output line and two capacitors ($C_S$, $C_{LS}$) connected in parallel; and wherein the said first capacitor and second capacitor are the storage capacitor and liquid crystal equivalent capacitor respectively and connected to ground, and the driving voltage output line is used to output the driving voltage used for simulation to the said pixels of the LCD panel so as to display images, and including backlight unit with adjustable and controllable luminance and backlight input voltage control line; and characterized in that the said input data line is connected to a data driver, the said input control line is connected to the gate driver, the said gate driver contains: the first, the second, and the third output enable (OE) input lines and the first, the second, and the third start pulse horizontal (STH) input lines, and receives the related signals via the said input lines, the said output enable (OE) signals input by the said gate drivers are so controlled that the two sets of synchronous control voltage pulses generated at the output of the said gate drivers are selected from the following three sets of control voltage pulses: (1) ($G_1$, $G_m$), (2) ($G_{m+1}$, $G_{2m}$), (3) ($G_{2m+1}$, $G_{3m}$); and these two sets of control voltage pulses (1, 3), or (1, 2), or (2, 3) are selected from the said three sets of control voltage pulses and then arranged and combined, such that they are provided to the gate of the said transistors through the corresponding first, or second, or third input control line in a cyclic alternating manner, and the driving voltage pulse $V_{LC}$ generated through the control of the gate can be used to drive the pixels to simultaneously generate two synchronous scanning lines separated by 2 m scanning lines on the display screen in a cyclic alternating manner, so as to display images; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Image Blurring Elimination Method

The following is the image blurring elimination method used for the image blurring elimination device according to the fifth embodiment of the present invention, comprising the following steps: (I) providing the data signal (D1) with periodic pulse waveform to the source of the said first transistor (Q1); (II) providing the OE and STH control signals to the first, second, and third output enable (OE) input lines and start pulse horizontal (STH) input lines of the said gate driver, and receiving the related signals via the said input lines, the said output enable (OE) signals input by the said gate drivers are so controlled that the two sets of synchronous control voltage pulses generated at the output of the said gate drivers are selected from the following three sets of control voltage pulses: (1) ($G_1$, $G_m$), (2) ($G_{m+1}$, $G_{2m}$), (3) ($G_{2m+1}$,$G_{3m}$); and these two sets of control voltage pulses (1, 3), or (1, 2), or (2, 3) are selected from the said three sets of control voltage pulses and then arranged and combined, such that they are provided to the gate of the said transistors (Q1) through the corresponding first, second, or third input control lines in a cyclic alternating manner and characterized in that when activated by the said two sets of synchronous control signals (1, 3), or (1, 2), or (2, 3), the said circuit feeds the said data signal to the said driving voltage output line; outputting the said output driving voltage generated by the above steps to the said pixels, so as to simultaneously generate two synchronous scanning lines separated by 2 m scanning lines on the display screen in a cyclic alternating manner, so as to display images; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Waveform Analysis

In the following analysis , please refer to FIGS. 12(*a*) to 12(*d*) as we describe in detail the relations between the waveforms of the driving voltage pulse of the liquid crystal molecules $V_{LC}$, the backlight control voltage BV, backlight luminance response BL, and the accumulated liquid crystal optical response Lq generated by the image blurring elimination device of FIGS. 1,11(*a*), and 11(*b*) of the fifth Embodiment.

Since usually AC voltage is utilized as the driving voltage for driving the liquid crystal, this voltage indicates the phenomenon of alternating positive and negative phases during the control and driving process of the liquid crystal (namely, the waveform of the pulse of driving voltage $V_{LC}$ indicate the phenomenon of alternating positive and negative phases relative to the reference voltage $V_{COM}$).

These waveforms proceed sequentially and periodically from time points A1 to A7 repeatedly in the following manner:

Before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and at this time the value of accumulated liquid crystal optical response is Lq1; then at time point A1 the waveform starts entering into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then time proceeds to time point A2, and at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then later to value Lq1 until time point A4; then the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 until time point A4; then the time proceeds to time point A4, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response decreases steadily via time point A6, then later decreases to Lq1 and then remains so until time point A7; then the time proceeds to time point A6, at this time the driving voltage pulse $V_{LC}$ still remains at $V_{1'}$ (code 0) of negative polarity, at this time the value of backlight control voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; then the time proceeds to time point A7 and the waveform start entering (N+2)th frame, and the waveform variations of the driving voltage pulse of the liquid crystal molecules $V_{LC}$, the backlight control voltage BV, backlight luminance response BL and the accumulated liquid crystal optical response Lq are the same as the waveform variations of those during the (N+1)th frame interval and between time points A4-A7. Therefore, it will not repeated here for brevity's sake. As to the various waveform variations during the respective frame interval after the (N+2)th frame, they can all be easily inferred and known based on the above explanations.

The dotted line as shown in FIG. 12(*a*) is the liquid crystal optical response characteristic curve produced while performing the simulation drive of CRT image display. When the output driving voltage $V_{LC}$ of the simulation device between each time point is code 0 as shown in the figure, this means that the black line scanning is performed on the display screen during this period, and by doing so, it can achieve the same results as inserting black frames. In addition, the luminance of the backlight unit is appropriately reduced by means of the design of the present invention, so as to enable the minimization of the accumulated liquid crystal optical response Lq, as such ensuring the elimination of the phenomenon of the "after image" overlap blurring between frames, and indeed achieving the purpose of simulating the CRT display impulse type image display with LCD display. And this is the most important advantage of the present invention over the prior art.

For the sake of easy and convenient explanation and understanding, the waveforms of the driving voltage pulse of the liquid crystal molecules $V_{LC}$, the backlight control voltage BV, backlight luminance response BL, and the accumulated liquid crystal optical response Lq output by the image blurring elimination device of the fifth Embodiment as shown above are the same as those of the subsequent sixth Embodiment, so as to avoid it being too complicated to understand in the process of explanation. However, the waveforms can be designed to have various variations according to the actual requirements of the LCD display.

Embodiment 6

In the following analyses, please refer to FIGS. 11(*a*), 11(*b*) and 13(*a*) to 13(*d*) as we explain sixth embodiment of the present invention. FIGS. 11(*a*) and 11(*b*) are used to describe the sixth Embodiment and the preceding fifth Embodiment of the present invention, its purpose is to indicate that different image display effects can be achieved on the display screen by utilizing different control methods with the same device.

Please refer to FIGS. 1, 11(*a*), 11(*b*) and 13(*a*) to 13(*d*) as we explain the sixth embodiment of the present invention.

First, please refer to FIG. 1, its indicates the structure arrangement of the liquid crystal display panel and backlight unit used according to the sixth embodiment of the present invention.

FIG. 11(*a*) indicates the pixel array formed by the cross points of a plurality of gate lines and data lines, and the simulation driving circuit formed by a plurality of data driver and gate driver according to the sixth embodiment of the present invention.

FIG. 11(*b*) represents the liquid crystal display simulation driving device according to the sixth embodiment.

Figures 13A, 13B, 13C, 13D:
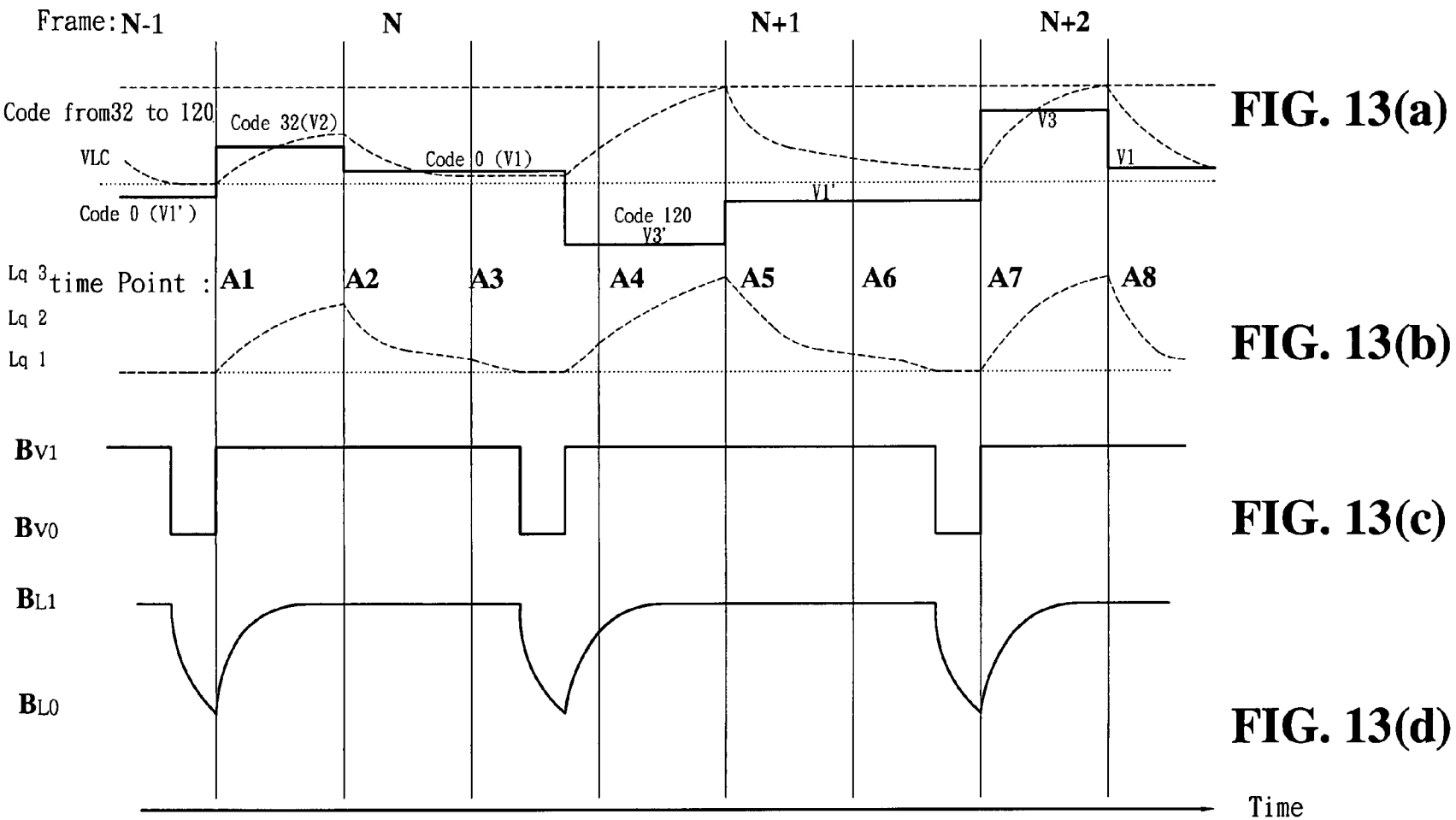
FIGS. 13(*a*) to 13(*d*) indicate the relations of the waveform curves between the driving voltage pulse of the liquid crystal molecules $V_{LC}$, the backlight control voltage BV, backlight luminance response BL, and the accumulated liquid crystal optical response Lq according to the sixth Embodiment of the present invention.

FIGS. 13(*a*) to 13(*d*) indicate the relations of the waveform curves between the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 11(*a*), and 11(*b*) of the sixth Embodiment.

Image Blurring Elimination Device

According to FIGS. 1, 11(*a*), and 11(*b*), the image blurring elimination device of the sixth Embodiment comprises: a first input control line($G_1$); a second input control line ($G_{m+1}$); a third input control line ($G_{2m+1}$); a first input data line ($D_1$); a first capacitor ($C_S$); a second capacitor ($C_{LS}$); a driving voltage output line; and a first transistor(Q1) comprising a gate connected to the first input control line or the second input control line or the third input control line; a source connected to the first input data line ($D_1$), and a drain connected to the driving voltage output line and two capacitors ($C_S$, $C_{LS}$) connected in parallel; and wherein the said first capacitor and second capacitor are the storage capacitor and liquid crystal equivalent capacitor respectively and connected to ground, and the driving voltage output line is used to output the driving voltage used for simulation to the said pixels of the LCD panel so as to display images, and including backlight unit with adjustable and controllable luminance and backlight input voltage control line; and characterized in that the said input data line is connected to a data driver, the said input control line is connected to the gate driver, the said gate driver contains: the first, the second, and the third output enable (OE) input lines and the first, the second, and the third start pulse horizontal (STH) input lines, and receives the related signals via the said input lines, the said output enable (OE) signals input by the said gate drivers are so controlled that the three sets of synchronous control voltage pulses generated at the output of the said gate drivers are formed by and selected from the following three sets of control voltage pulses: (1) ($G_1$, $G_m$), (2) ($G_{m+1}$, $G_{2m}$), (3) ($G_{2m+1}$, $G_{3m}$); and these three sets control voltage pulses (1, 2, 3) are provided to the gate of the said transistors (Q1) through the corresponding first, or second, and third input control lines, and when activated by the said three sets of synchronous control signals (1, 2, 3), the said circuit feeds the said data signal to the said driving voltage output line; and the driving voltage pulse $V_{LC}$ generated through the control of the gate can be used to drive the pixels to simultaneously generate three synchronous scanning lines separated by m scanning lines on the display screen, so as to display images; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Image Blurring Elimination Method

The following is the image blurring elimination method used for the image blurring elimination device according to the sixth embodiment of the present invention, comprising the following steps: (I) providing the data signal (D1) with periodic pulse waveform to the source of the said first transistor (Q1); (II) providing the OE and STH control signals to the first, second, and third output enable (OE) input lines and start pulse horizontal (STH) input lines of the said gate driver, and receiving the related signals via the said input lines, the said output enable (OE) signals input by the said gate drivers are so controlled that the three sets of synchronous control voltage pulses generated at the output of the said gate drivers are selected from the following three sets of control voltage pulses: (1) ($G_1$, $G_m$), (2) ($G_{m+1}$, $G_{2m}$), (3) ($G_{2m+1}$, $G_{3m}$); and these three sets of control voltage pulses (1, 2, 3) are provided to the gate of the said transistors (Q1) through the corresponding first, second and third input control lines, and characterized in that when activated by the said three sets of synchronous control signals (1, 2, 3), the said circuit feeds the said data signal to the said driving voltage output line; outputting the said output driving voltage generated by the above steps to the said pixels, so as to simultaneously generate three synchronous scanning lines separated by m scanning lines on the display screen in a cyclic alternating manner, so as to display images; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

Waveform Analysis

In the following analysis, please refer to FIGS. 13(*a*) to 13(*d*) as we describe in detail the relations between the waveforms of the driving voltage pulse of the liquid crystal molecules $V_{LC}$, the backlight control voltage BV, backlight luminance response BL, and the accumulated liquid crystal optical response Lq generated by the image blurring elimination device of FIGS. 1, 11(*a*), and 11(*b*) of the sixth Embodiment.

Since the description relating to the process of waveform progression of Embodiment 6 is the same as that of Embodiment 5, please refer to the contents of "the waveform analysis" of Embodiment 5 for its clear and complete understanding, and it will not be repeated here for brevity's sake.

The dotted line as shown in FIG. 13(*a*) is the liquid crystal optical response characteristic curve produced while performing the simulation drive of CRT image display. When the output driving voltage of the simulation device between each time point is code 0 as shown in the figure, this means that the black line scanning is performed on the display screen during this period, and by doing so, it can achieve the same results as inserting black frames. In addition, the luminance of the backlight unit is appropriately reduced by means of the design of the present invention, so as to enable the minimization of the accumulated liquid crystal optical response Lq, as such ensuring the elimination of the phenomenon of the "after image" overlap blurring between frames, and indeed achieving the purpose of simulating the CRT display impulse type image display with LCD display. And this is the most important advantage of the present invention over prior art.

For the sake of easy and convenient explanation and understanding, the waveforms of the driving voltage pulse of the liquid crystal molecules $V_{LC}$, the backlight control voltage BV, backlight luminance response BL, and the accumulated liquid crystal optical response Lq output by the image blurring elimination device of the Embodiment 6 as shown above are the same as those of the preceding Embodiment 5, so as to avoid it being too complicated to understand in the process of explanation. However, the waveforms can be designed to have various variations according to the actual requirements of the LCD display.

Summing up the above, "method and device used in eliminating the image overlap blurring phenomenon between frames in the process of simulating CRT impulse type image display" can indeed overcome and improve the drawbacks and limitations of the similar liquid crystal display of the prior art. And during the interval of scanning black lines, when the luminance of the backlight unit is reduced to the lowest value via control voltage, the accumulated liquid crystal optical response can be reduced to its lowest value in that interval so as to achieve the purpose of eliminating the after image overlap blurring of the displayed frames. Besides, it can save the extra cost and expense of the additional equipment and significantly improve its functions. Therefore, the method and device used by the present invention are indeed superior to those of the prior art. The present invention does have the value of utilization in the industry, and it does contain novelty and inventive steps, and it is in conformity with the patent requirements.

The description mentioned above only relates to the preferred Embodiments of the present invention, and it is intended to be illustrative rather than restrictive to the contents of the claims and the present invention; and various changes and modifications can be made by the people familiar with this technology without departing from the scope of the present invention and the appended claims.

What is claimed is:

1. A device used for eliminating the image overlap blurring in the process of simulating CRT impulse type image display, comprising:

a first input control line;

a second input control line;

a first input data line;

a second input data line;

a first capacitor;

a second capacitor;

driving voltage output line;

a first transistor comprising a first gate connected to the first input control line, a first source connected to the first input data line, and a first drain connected to the driving voltage output line and the first capacitor and the drain of the second transistor; and a second transistor, comprising: a second gate connected to the second input control line, a second source connected to the second input data line, a second drain connected to the drain of the said first transistor and the second capacitor and driving voltage output line;

wherein the said first capacitor and the said second capacitor are storage capacitor and liquid crystal equivalent capacitor respectively and are connected to ground, the driving voltage output line is used to output the driving voltage used for simulation to the said pixels of the LCD panel so as to display images, and including backlight unit with adjustable and controllable luminance and backlight input voltage control line;

and characterized in that the said first and second input control lines are connected to a gate driver, and the said first and second input data lines are connected to a data driver respectively;

the time difference of the periodic pulse waveforms between the first and second control signals is the time difference across n scanning lines generated by n pulses, and which can be adjusted; and during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

2. The device as claimed in claim 1, wherein the backlight unit is made of one of the following materials depending on the accumulated liquid crystal optical response desired to be achieved, the quality and effectiveness of the image display desired to be achieved by the liquid crystal display: cold cathode fluorescence lamp (CCFL), light emitting diode (LED), organic light emitting diode (OLED), polymer light emitting diode (PLED) and electro luminance (EL); and the luminance response mode of the backlight unit is the immediate target value mode (LED, OLED, PLED, EL) or gradual target value mode (CCFL).

3. The device as claimed in claim 1, wherein the following attributes of the backlight unit luminance response and the resulting attributes of liquid crystal accumulated optical response is controlled and adjusted depending on the image displaying quality of the liquid crystal display desired to be achieved:

(1) the starting point of the lowest value of the backlight unit luminance response, (2) the temporal width (namely, length) of the lowest value of the backlight unit luminance response, (3) the depth of the lowest value of backlight unit luminance response, (4) the starting point of the lowest value of the liquid crystal accumulated optical response, (5) the temporal width (namely, length) of the lowest value of the liquid crystal accumulated optical response, and (6) the depth of the lowest value of the liquid crystal accumulated optical response.

4. A method used for eliminating the image overlap blurring in the process of simulating CRT impulse type image display, comprising the following steps:

(A) providing a circuit comprising a first input control line, a second input control line, a first input data line, a second input data line, a first transistor, a second transistor, a first capacitor, a second capacitor, and a driving voltage output line;

(B) providing the first control signal with periodic pulse waveforms to the first gate of the first transistor of the said circuit;

(C) providing the second control signal with periodic pulse waveforms to the second gate of the second transistor of the said circuit;

(D) the second control signal is the same as the first control signal except the phase delay;

(E) providing the first data signal to the source of the first transistor of the said circuit, when activated by the said first control signal, the said circuit feeds the first data signal to the said driving voltage output line;

(F) providing the second data signal to the source of the second transistor of the said circuit, when activated by the said second control signal, the said circuit feeds the second data signal to the said driving voltage output line;

(G) outputting the said output driving voltages generated by the above steps to the said pixels, so as to display images; and (H) during the interval of black lines scanning, when the luminance of the backlight unit is reduced to the lowest value through its control voltage, the accumulated liquid crystal optical response in that interval can be brought to the lowest value, so as to achieve the purpose and effectiveness of eliminating the after image overlap blurring between the frames.

5. The method as claimed in claim 4, wherein since AC voltage is used as the control voltage and driving voltage, these voltages indicate the phenomenon of alternating positive and negative phases during their control and driving processes, and their waveforms proceed sequentially and periodically from time points A1 to A7 repeatedly in the following manner:

(a) before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and the value of accumulated liquid crystal optical response is Lq1; then (b) at time point A1 the waveform enters into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then (c) the time proceeds to time point A2, at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then to value Lq1 at time point A4; then (d) the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 and remains so until time point A4; then (e) the time proceeds to time point A4, and the waveform enters the (N+1)th frame, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then (f) the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response steadily decreases via time point A6, and it later decreases to Lq1 and then remains so until time point A7; then (g) the time proceeds to time point A6, at this time the driving voltage pulse $V_{LC}$ still remains at $V_{1'}$ (code 0) of negative polarity, at this time the value of backlight control voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; then (h) the time proceeds to time point A7 and the waveform start entering (N+2)th frame, and the descriptions of the various waveforms are the same as those for the (N+1)th frame between time points A4-A7 as described in the above steps (e)-(g).

6. A device used for eliminating the image overlap blurring in the process of simulating CRT impulse type image display, comprising:

a first input control line;

a second input control line;

a first input data line;

a second input data line;

a third input data line;

a fourth input data line;

a fifth input data line;

a first capacitor;

a second capacitor;

a third transistor;

a fourth transistor;

driving voltage output line;

a first transistor comprising a first gate connected to the first input control line, a first source connected to the first input data line, and a first drain connected to the driving voltage output line and the first capacitor and the drain of the second transistor;

a second transistor comprising a second gate connected to the second input control line, a second source connected to the second input data line, a second drain connected to the drain of the said first transistor and the second capacitor and driving voltage output line;

wherein the said first capacitor and the said second capacitor are storage capacitor and liquid crystal equivalent capacitor respectively and are connected to ground, the driving voltage output line is used to output the driving voltage used for simulation to the said pixels of the LCD panel so as to display images, and including backlight unit with adjustable and controllable luminance and backlight input voltage control line;

and characterized in that the said first and second input control lines are connected to a gate driver, and the said first and second input data lines are connected to the drains of two another switching transistors connected in parallel, the sources of the said two switching transistors connected in parallel are connected to a data driver, with its gate connected to the third and fourth input data lines;

and the time difference between the periodic pulse waveforms of the said first and second control signals is the time difference across n scanning lines generated by n pulses, and which can be adjusted; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

7. The device as claimed in claim 6, wherein the backlight unit is made of one of the following materials depending on the accumulated liquid crystal optical response desired to be achieved, the quality and effectiveness of the image display desired to be achieved by the liquid crystal display: cold cathode fluorescence lamp (CCFL), light emitting diode (LED), organic light emitting diode (OLED), polymer light emitting diode (PLED) and electro luminance (EL); and the luminance response mode of the backlight unit is: the immediate target value mode (LED, OLED, PLED, EL) or gradual target value mode (CCFL).

8. The device as claimed in claim 6, wherein the following attributes of the backlight unit luminance response and the resulting attributes of liquid crystal accumulated optical response is controlled and adjusted depending on the image displaying quality of the liquid crystal display desired to be achieved:

(1) the starting point of the lowest value of the backlight unit luminance response, (2) the temporal width (namely, length) of the lowest value of the backlight unit luminance response, (3) the depth of the lowest value of backlight unit luminance response, (4) the starting point of the lowest value of the liquid crystal accumulated optical response, (5) the temporal width (namely, length) of the lowest value of the liquid crystal accumulated optical response, and (6) the depth of the lowest value of the liquid crystal accumulated optical response.

9. A method used for eliminating the image overlap blurring in the process of simulating CRT impulse type image display, comprising the following steps:

(A) providing a circuit, comprising a first input control line, a second input control line, a first input data line, a second input data line, a third input data line, a fourth input data line, a fifth input data line, a first transistor, a second transistor, a third transistor, a fourth transistor, a first capacitor, a second capacitor, and a driving voltage output line;

(B) providing the first control signal with periodic pulse waveforms to the first gate of the first transistor of the said circuit;

(C) providing the second control signal with periodic pulse waveforms to the second gate of the second transistor of the said circuit, the second control signal being the same as the first control signal except the phase delay;

(D) providing the fifth data signal to the sources of the third transistor and fourth transistor connected in parallel;

(E) providing the third data signal to the gate of the third transistor;

(F) providing the voltage pulse generated by the drain of the third transistor to the source of the first transistor as the first data signal, when the said first transistor is activated by the first control signal, the first data signal is fed by the said circuit to the driving voltage output line;

(G) providing the fourth data signal to the gate of the fourth transistor;

(H) providing the voltage pulse generated by the drain of the fourth transistor to the source of the second transistor as the second data signal, when the said second transistor is activated by the second control signal, the second data signal is fed by the said circuit to the driving voltage output line; and (I) outputting the said output driving voltage generated by the above steps to the said pixels so as to display images;

(J) during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

10. The method as claimed in claim 9, wherein since AC voltage is used as the control voltage and driving voltage, these voltages indicate the phenomenon of alternating positive and negative phases during their control and driving processes, and their waveforms proceed sequentially and periodically from time points A1 to A7 repeatedly in the following manner:

(a) before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and the value of accumulated liquid crystal optical response is Lq1; then (b) at time point A1 the waveform enters into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then (c) the time proceeds to time point A2, at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then to value Lq1 at time point A4; then (d) the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 and remains so until time point A4; then (e) the time proceeds to time point A4, and the waveform enters the (N+1)th frame, at this time the value of the driving voltage pulse $V_{LC}$ drops from $V_1$ (code 0) to $V_{3'}$ (code 12O) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then (f) the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response steadily decreases via time point A6, and it later decreases to Lq1 and then remains so until time point A7; then (g) the time proceeds to time point A6, at this time the driving voltage pulse $V_{LC}$ still remains at $V_{1'}$ (code 0) of negative polarity, at this time the value of backlight control voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; then (h) the time proceeds to time point A7 and the waveform start entering (N+2)th frame, and the descriptions of the various waveforms are the same as those for the (N+1)th frame between time points A4-A7 as described in the above steps (e)-(g).

11. A device used for eliminating the image overlap blurring in the process of simulating CRT impulse type image display, comprising:

a first input control line;

a second input control line;

a first input data line;

a first capacitor;

a second capacitor;

driving voltage output line;

a first transistor comprising a first gate connected to the first input control line, a first source connected to the first input data line, and a first drain connected to the driving voltage output line and the first capacitor and the second drain of the second transistor; and a second transistor comprising a second gate connected to the second input control line, a second source connected to ground, a second drain connected to the drain of the said first transistor and the second capacitor and driving voltage output line;

wherein the said first capacitor and the said second capacitor are storage capacitor and liquid crystal equivalent capacitor respectively and are connected to ground, the driving voltage output line is used to output the driving voltage used for simulation to the said pixels of the LCD panel so as to display images, and including backlight unit with adjustable and controllable luminance and backlight input voltage control line;

and characterized in that the said first and second input control lines are connected to a gate driver, and the said first input data line is connected to a data driver;

the time difference between the waveforms of the periodic pulses of the first and second control signals is the time difference across n scanning lines generated by n pulses, and which is adjusted; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

12. The device as claimed in claim 11, wherein the backlight unit is made of one of the following materials depending on the accumulated liquid crystal optical response desired to be achieved, the quality and effectiveness of the image display desired to be achieved by the liquid crystal display: cold cathode fluorescence lamp (CCFL), light emitting diode (LED), organic light emitting diode (OLED), polymer light emitting diode (PLED) and electro luminance (EL); and the luminance response mode of the backlight unit is: the immediate target value mode (LED, OLED, PLED, EL) or gradual target value mode (CCFL).

13. The device as claimed in claim 11, wherein the following attributes of the backlight unit luminance response and the resulting attributes of liquid crystal accumulated optical response is controlled and adjusted depending on the image displaying quality of the liquid crystal display desired to be achieved:

(1) the starting point of the lowest value of the backlight unit luminance response, (2) the temporal width (namely, length) of the lowest value of the backlight unit luminance response, (3) the depth of the lowest value of backlight unit luminance response, (4) the starting point of the lowest value of the liquid crystal accumulated optical response, (5) the temporal width (namely, length) of the lowest value of the liquid crystal accumulated optical response, and (6) the depth of the lowest value of the liquid crystal accumulated optical response.

14. A method used for eliminating the image overlap blurring in the process of simulating CRT impulse type image display, comprising the following steps:

(A) providing a circuit, comprising a first input control line, a second input control line, a first input data line, a first transistor, a second transistor, a first capacitor, a second capacitor, and a driving voltage output line;

(B) providing the first control signal with periodic pulse waveforms to the first gate of the first transistor of the said circuit;

(C) providing the second control signal with periodic pulse waveforms to the second gate of the second transistor of the said circuit;

(D) the second control signal is the same as the first control signal except the phase delay;

(E) providing the first data signal to the source of the first transistor of the said circuit, when activated by the said first control signal, the said circuit feeds the first data signal to the said driving voltage output line;

(F) when activated by the second control signal, the ground potential voltage is fed by the said circuit to the driving voltage output line;

(G) outputting the said output driving voltages generated by the above steps to the said pixels so as to display images; and (H) during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

15. The method as claimed in claim 14, wherein since AC voltage is used as the control voltage and driving voltage, these voltages indicate the phenomenon of alternating positive and negative phases during their control and driving processes, and their waveforms proceed sequentially and periodically from time points A1 to A7 repeatedly in the following manner:

(a) before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and the value of accumulated liquid crystal optical response is Lq1; then (b) at time point A1 the waveform enters into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then (c) the time proceeds to time point A2, at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then to value Lq1 at time point A4; then (d) the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 and remains so until time point A4; then (e) the time proceeds to time point A4, and the waveform enters the (N+1)th frame, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then (f) the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response steadily decreases via time point A6, and it later decreases to Lq1 and then remains so until time point A7; then (g) the time proceeds to time point A6, at this time the driving voltage pulse $V_{LC}$ still remains at $V_{1'}$ (code 0) of negative polarity, at this time the value of backlight control voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; and then (h) the time proceeds to time point A7 and the waveform start entering (N+2)th frame, and the descriptions of the various waveforms are the same as those for the (N+1)th frame between time points A4-A7 as described in the above steps (e)-(g).

16. A device used for eliminating the image overlap blurring in the process of simulating CRT impulse type image display, comprising:

a first input control line;

a second input control line;

a first input data line;

a first capacitor;

a second capacitor;

a driving voltage output line; and a first transistor comprising a gate connected to the first input control line or the second input control line, a source connected to the input data line, and a drain connected to the driving voltage output line and two capacitors connected in parallel; and wherein the said first capacitor and second capacitor are connected to ground, and the driving voltage output line is used to output the driving voltage used for simulation to the said pixels of the LCD panel so as to display images, and including backlight unit with adjustable and controllable luminance and backlight input voltage control line;

and characterized in that the said input data line is connected to a data driver, the said input control line is connected to the gate driver, the said gate driver contains: an output enable (OE) input line and a start pulse horizontal (STH) input line and receives the related signals via the said input lines, so as to generate the synchronous control voltage pulses $G_1$, $G_m$ of the said input control lines, and supply them to the gate of the said transistor via the first and second input control lines, and to generate the driving voltage pulse $V_{LC}$ through its control, and then be able to generate two synchronous scanning lines separated by m scanning lines on the display screen simultaneously, so as to display images; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

17. The device as claimed in claim 16, wherein the backlight unit is made of one of the following materials depending on the accumulated liquid crystal optical response desired to be achieved, the quality and effectiveness of the image display desired to be achieved by the liquid crystal display: cold cathode fluorescence lamp (CCFL), light emitting diode (LED), organic light emitting diode (OLED), polymer light emitting diode (PLED) and electro luminance (EL); and the luminance response mode of the backlight unit is: the immediate target value mode (LED, OLED, PLED, EL) or gradual target value mode (CCFL).

18. The device as claimed in claim 16, wherein the following attributes of the backlight unit luminance response and the resulting attributes of liquid crystal accumulated optical response is controlled and adjusted depending on the image displaying quality of the liquid crystal display desired to be achieved:

(1) the starting point of the lowest value of the backlight unit luminance response, (2) the temporal width (namely, length) of the lowest value of the backlight unit luminance response, (3) the depth of the lowest value of backlight unit luminance response, (4) the starting point of the lowest value of the liquid crystal accumulated optical response, (5) the temporal width (namely, length) of the lowest value of the liquid crystal accumulated optical response, and (6) the depth of the lowest value of the liquid crystal accumulated optical response.

19. A method used for eliminating the image overlap blurring in the process of simulating CRT impulse type image display, comprising the following steps:

(A) providing a circuit, comprising a first input control line, a second input control line, a first input data line, a first transistor, a first capacitor, a second capacitor, and a driving voltage output line;

(B) providing the data signal with periodic pulse waveform to the source of the said first transistor;

(C) providing control signals OE and STH to the gate driver, so as to generate the synchronous control signals G1,Gm, and providing them to the gate of the said transistor via the first and second input control lines;

(D) when activated by the said synchronous control signals G1,Gm, the said circuit feeds the said data signal to the said driving voltage output line; and (E) outputting the said output driving voltage generated by the above steps to the said pixels so as to display images; and (F) during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

20. The method as claimed in claim 19, wherein since AC voltage is used as the control voltage and driving voltage, these voltages indicate the phenomenon of alternating positive and negative phases during their control and driving processes, and their waveforms proceed sequentially and periodically from time points A1 to A7 repeatedly in the following manner:

(a) before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and the value of accumulated liquid crystal optical response is Lq1; then (b) at time point A1 the waveform enters into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then (c) the time proceeds to time point A2, at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then to value Lq1 at time point A4; then (d) the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 and remains so until time point A4; then (e) the time proceeds to time point A4, and the waveform enters the (N+1)th frame, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then (f) the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response steadily decreases via time point A6, and it later decreases to Lq1 and then remains so until time point A7; then (g) the time proceeds to time point A6, at this time the driving voltage pulse $V_{LC}$ still remains at $V_{1'}$ (code 0) of negative polarity, at this time the value of backlight control voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; and then (h) the time proceeds to time point A7 and the waveform start entering (N+2)th frame, and the descriptions of the various waveforms are the same as those for the (N+1)th frame between time points A4-A7 as described in the above steps (e)-(g).

21. A device used for eliminating the image overlap blurring in the process of simulating CRT impulse type image display, comprising:

a first input control line;

a second input control line;

a third input control line;

a first input data line;

a first capacitor;

a second capacitor;

a driving voltage output line; and a first transistor comprising a gate connected to the first input control line or the second input control line or the third input control line; a source connected to the first input data line, and a drain connected to the driving voltage output line and two capacitors connected in parallel; and wherein the said first capacitor and second capacitor are the storage capacitor and liquid crystal equivalent capacitor respectively and connected to ground, the driving voltage output line is used to output the driving voltage used for simulation to the said pixels of the LCD panel so as to display images, and including backlight unit with adjustable and controllable luminance and backlight input voltage control line;

and characterized in that the said input data line is connected to a data driver, the said input control line is connected to the gate driver, the said gate driver contains: the first, the second, and the third output enable (OE) input lines and the first, the second, and the third start pulse horizontal (STH) input lines, and receives the related signals via the said input lines, the said output enable (OE) signals input by the said gate drivers are so controlled that the two sets of synchronous control voltage pulses generated at the output of the said gate drivers are selected from the following three sets of control voltage pulses: (1) ($G_1$, $G_m$), (2) ($G_{m+1}$, $G_{2m}$), (3) ($G_{2m+1}$, $G_{3m}$); and these two sets of control voltage pulses (1, 3), or (1, 2), or (2, 3) are selected from the said three sets of control voltage pulses and then arranged and combined, such that they are provided to the gate of the said transistors through the corresponding first, or second, or third input control line in a cyclic alternating manner, and the driving voltage pulse $V_{LC}$ generated through the control of the gate is used to drive the pixels to simultaneously generate two synchronous scanning lines separated by 2 m scanning lines on the display screen in a cyclic alternating manner, so as to display images; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

22. The device as claimed in claim 21, wherein the backlight unit is made of one of the following materials depending on the accumulated liquid crystal optical response desired to be achieved, the quality and effectiveness of the image display desired to be achieved by the liquid crystal display: cold cathode fluorescence lamp (CCFL), light emitting diode (LED), organic light emitting diode (OLED), polymer light emitting diode (PLED) and electro luminance (EL); and the luminance response mode of the backlight unit is: the immediate target value mode (LED, OLED, PLED, EL) or gradual target value mode (CCFL).

23. The device as claimed in claim 21, wherein the following attributes of the backlight unit luminance response and the resulting attributes of liquid crystal accumulated optical response is controlled and adjusted depending on the image displaying quality of the liquid crystal display desired to be achieved:

(1) the starting point of the lowest value of the backlight unit luminance response, (2) the temporal width (namely, length) of the lowest value of the backlight unit luminance response, (3) the depth of the lowest value of backlight unit luminance response, (4) the starting point of the lowest value of the liquid crystal accumulated optical response, (5) the temporal width (namely, length) of the lowest value of the liquid crystal accumulated optical response, and (6) the depth of the lowest value of the liquid crystal accumulated optical response.

24. A method used for eliminating the image overlap blurring in the process of simulating CRT impulse type image display, comprising the following steps:

(A) providing a circuit comprising a first input control line, a second input control line, a third input control line, a first input data line, a first transistor, a first capacitor, a second capacitor, and a driving voltage output line;

(B) providing the data signal with periodic pulse waveform to the source of the said first transistor;

(C) providing the OE and STH control signals to the first, second, and third output enable (OE) input lines and start pulse horizontal (STH) input lines of the said gate driver, and (D) receiving the related signals via the said input lines, the said output enable (OE) signals input by the said gate drivers are so controlled that the two sets of synchronous control voltage pulses generated at the output of the said gate drivers are selected from the following three sets of control voltage pulses: (1) ($G_1$, $G_m$), (2) ($G_{m+1}$, $G_{2m}$), (3) ($G_{2m+1}$, $G_{3m}$); and these two sets of control voltage pulses (1, 3), or (1, 2), or (2, 3) are selected from the said three sets of control voltage pulses and then arranged and combined, such that they are provided to the gate of the said transistors through the corresponding first, second, or third input control lines in a cyclic alternating manner, and characterized in that when activated by the said two sets of synchronous control signals (1, 3), or (1, 2), or (2, 3), the said circuit feeds the said data signal to the said driving voltage output line; and outputting the said output driving voltage generated by the above steps to the said pixels, so as to simultaneously generate two synchronous scanning lines separated by 2m scanning lines on the display screen in a cyclic alternating manner, so as to display images; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

25. The method as claimed in claim 24, wherein since AC voltage is used as the control voltage and driving voltage, these voltages indicate the phenomenon of alternating positive and negative phases during their control and driving processes, and their waveforms proceed sequentially and periodically from time points A1 to A7 repeatedly in the following manner:

(a) before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and at this time the value of accumulated liquid crystal optical response is Lq1; then (b) at time point A1 the waveform starts entering into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then (c) time proceeds to time point A2, and at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then later to value Lq1 until time point A4; then (d) the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 until time point A4; then (e) the time proceeds to time point A4, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then (f) the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response decreases steadily via time point A6, then later decreases to Lq1 and then remains so until time point A7; then (g) the time proceeds to time point A6, at this time the driving voltage pulse $V_{LC}$ still voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; and then (h) the time proceeds to time point A7 and the waveform start entering (N+2)th frame, and the descriptions of the various waveforms are the same as those for the (N+1)th frame between time points A4-A7 as described in the above steps (e)-(g).

26. A device used for eliminating the image overlap blurring in the process of simulating CRT impulse type image display, comprising:

a first input control line;

a second input control line;

a third input control line;

a first input data line;

a first capacitor;

a second capacitor;

a driving voltage output line; and a first transistor comprising a gate connected to the first input control line or the second input control line or the third input control line, a source connected to the first input data line, and a drain connected to the driving voltage output line and two capacitors connected in parallel; and wherein the said first capacitor and second capacitor are the storage capacitor and liquid crystal equivalent capacitor respectively and connected to ground, and the driving voltage output line is used to output the driving voltage used for simulation to the said pixels of the LCD panel so as to display images, and including backlight unit with adjustable and controllable luminance and backlight input voltage control line;

and characterized in that the said input data line is connected to a data driver, the said input control the is connected to the gate driver, the said gate driver contains: the first, the second, and the third output enable (OE) input lines and the first, the second, and the third start pulse horizontal (STH) input lines, and receives the related signals via the said input lines, the said output enable (OE) signals input by the said gate drivers are so controlled that the three sets of synchronous control voltage pulses generated at the output of the said gate drivers are formed by and selected from the following three sets of control voltage pulses: (1) ($G_1$, $G_m$),(2) ($G_{m+1}$, $G_{2m}$),(3) ($G_{2m+1}$, $G_{3m}$); and these three sets control voltage pulses (1, 2, 3) are provided to the gate of the said transistors through the corresponding first, or second, and third input control lines;

when activated by the said three sets of synchronous control signals (1, 2, 3) the said circuit feeds the said data signal to the said driving voltage output line; and the driving voltage pulse $V_{LC}$ generated through the control of the gate is used to drive the pixels to simultaneously generate three synchronous scanning lines separated by m scanning lines on the display screen, so as to display images; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

27. The device as claimed in claim 26, wherein the backlight unit is made of one of the following materials depending on the accumulated liquid crystal optical response desired to be achieved, the quality and effectiveness of the image display desired to be achieved by the liquid crystal display: cold cathode fluorescence lamp (CCFL), light emitting diode (LED), organic light emitting diode (OLED), polymer light emitting diode (PLED) and electro luminance (EL); and the luminance response mode of the backlight unit is: the immediate target mode (LED, OLED, PLED, EL) or gradual target value mode (CCFL).

28. The device as claimed in claim 26, wherein the following attributes of the backlight unit luminance response and the resulting attributes of liquid crystal accumulated optical response is controlled and adjusted depending on the image displaying quality of the liquid crystal display desired to be achieved:

(1) the starting point of the lowest value of the backlight unit luminance response, (2) the temporal width (namely, length) of the lowest value of the backlight unit luminance response, (3) the depth of the lowest value of backlight unit luminance response, (4) the starting point of the lowest value of the liquid crystal accumulated optical response, (5) the temporal width (namely, length) of the lowest value of the liquid crystal accumulated optical response, and (6) the depth of the lowest value of the liquid crystal accumulated optical response.

29. A method used for eliminating the image overlap blurring in the process of simulating CRT impulse type image display, comprising the following steps:

(A) providing a circuit comprising a first input control line, a second input control line, a third input control line, a first input data line, a first transistor, a first capacitor, a second capacitor, and a driving voltage output line;

(B) providing the data signal with periodic pulse waveform to the source of the said first transistor;

(C) providing the OE and STH control signals to the first, second, and third output enable (OE) input lines and start pulse horizontal (STH) input lines of the said gate driver, and (D) receiving the related signals via the said input lines, the said output enable (OE) signals input by the said gate drivers are so controlled that the three sets of synchronous control voltage pulses generated at the output of the said gate drivers are selected from the following three sets of control voltage pulses: (1) ($G_1$, $G_m$), (2) ($G_{m+1}$, $G_{2m}$), (3) ($G_{2m+1}$, $G_{3m}$); and these three sets of control voltage pulses (1, 2, 3) are provided to the gate of the said transistors through the corresponding first, second and third input control lines;

and characterized in that when activated by the said three sets of synchronous control signals (1, 2, 3), the said circuit feeds the said data signal to the said driving voltage output line; and outputting the said output driving voltage generated by the above steps to the said pixels, so as to simultaneously generate three synchronous scanning lines separated by m scanning lines on the display screen in a cyclic alternating manner, so as to display images; and during the interval of black lines scanning, when the luminance of the backlight unit is reduced to the lowest value through its control voltage, the accumulated liquid crystal optical response in that interval is brought to the lowest value, so as to achieve the purpose and effectiveness of eliminating the after image overlap blurring between the frames.

30. The method as claimed in claim 29, wherein since AC voltage is used as the control voltage and driving voltage, these voltages indicate the phenomenon of alternating positive and negative phases during their control and driving processes, and their waveforms proceed sequentially and periodically from time points A1 to A7 repeatedly in the following manner:

(a) before time point A1, the driving voltage value $V_{LC}$ in the (N−1)th frame is $V_{1'}$ (code 0) of negative polarity, the value of backlight control voltage BV is BV0, and the value of backlight luminance response BL is BL0, and at this time the value of accumulated liquid crystal optical response is Lq1; then (b) at time point A1 the waveform starts entering into the Nth frame, at this time the value of the driving voltage pulse $V_{LC}$ increases to $V_2$ (code 32) of positive polarity, and it remains so until time point A2, at this time the backlight control voltage BV increases to BV1, and the value of backlight luminance response BL increases gradually from BL0 to BL1, at this time the accumulated liquid crystal optical response Lq increases gradually from Lq1 at time point A1 to Lq2 at time point A2; then (c) time proceeds to time point A2, and at this time the value of the driving voltage pulse $V_{LC}$ decreases from $V_2$ (code 32) to $V_1$ (code 0) of positive polarity, and the value of the backlight control voltage BV still remains at BV1, the backlight luminance response BL still remains at BL1, and the accumulated liquid crystal optical response decreases from Lq2 at time point A2, via time point A3 and then later to value Lq1 until time point A4; then (d) the time proceeds to time point A3, at this time the value of the driving voltage pulse $V_{LC}$ still remains at $V_1$ (code 0) of positive polarity, and the value of the backlight control voltage BV decreases to BV0, the value of backlight luminance response BL gradually decreases from BL1 at time point A3 to BL0 at time point A4, and the accumulated liquid crystal optical response later drops to Lq1 until time point A4; then (e) the time proceeds to time point A4, at this time the value of the driving voltage pulse $V_{LC}$ drops from $V_1$ (code 0) to $V_{3'}$ (code 120) of negative polarity, the value of backlight control voltage BV increases to BV1, and the value of backlight luminance response BL start gradually increasing to BL1, and the accumulated liquid crystal optical response start gradually increasing from Lq1 at time point A4 to Lq3 at time point A5; then (f) the time proceeds to time point A5, at this time the value of the driving voltage pulse $V_{LC}$ increases to $V_{1'}$ (code 0) of negative polarity, at this time the value of backlight control voltage BV still remains at BV1, the value of backlight luminance BL still remains at BL1, and the accumulated liquid crystal optical response decreases steadily via time point A6, then later decreases to Lq1 and then remains so until time point A7; then (g) the time proceeds to time point A6, at this time the driving voltage pulse $V_{LC}$ still voltage BV decreases from BV1 to BV0, and it remains so until time point A7, the value of the backlight luminance response BL decreases gradually from BL1 at time point A6 to BL0 at time point A7, and the accumulated liquid crystal optical response later drops to Lq1 and remains so until time point A7; and then (h) the time proceeds to time point A7 and the waveform start entering (N+2)th frame, and the descriptions of the various waveforms are the same as those for the (N+1)th frame between time points A4-A7 as described in the above steps (e)-(g).

* * * * *